US011312554B2

(12) United States Patent
Cardin et al.

(10) Patent No.: US 11,312,554 B2
(45) **Date of Patent: *Apr. 26, 2022**

(54) EASY-OPEN PEEL POUCH

(71) Applicant: Sunovion Pharmaceuticals Inc., Marlborough, MA (US)

(72) Inventors: Julie A. Cardin, Hastings, MN (US); Edward Emmett Chapdelaine, South St. Paul, MN (US); Steven A. Rau, Farmington, MN (US)

(73) Assignee: Sunovion Pharmaceuticals Inc., Marlborough, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/029,468

(22) Filed: Sep. 23, 2020

(65) Prior Publication Data

US 2021/0002051 A1 Jan. 7, 2021

Related U.S. Application Data

(63) Continuation of application No. 15/616,666, filed on Jun. 7, 2017, now Pat. No. 10,815,042.

(Continued)

(51) Int. Cl.
*B65D 75/58* (2006.01)
*B65B 9/00* (2006.01)

(Continued)

(52) U.S. Cl.
CPC ..... *B65D 75/5855* (2013.01); *B65B 7/02* (2013.01); *B65B 9/00* (2013.01); *B65B 9/02* (2013.01);

(Continued)

(58) Field of Classification Search
CPC .... B65D 75/5855; B65D 75/30; B65D 75/50; B65D 75/52; B65D 75/5805;

(Continued)

(56) References Cited

U.S. PATENT DOCUMENTS 2,552,870 A * 5/1951 Scherer ..... B65D 75/5855 222/107
2,648,463 A * 8/1953 Scherer ..... B65D 75/5855 222/107

(Continued)

FOREIGN PATENT DOCUMENTS

DE 102004047445 A1 4/2006
EP 0291065 A2 11/1988

(Continued)

OTHER PUBLICATIONS

International Search Report for International Application No. PCT/US2017/036600, dated Oct. 4, 2017 (4 pages).

(Continued)

*Primary Examiner* — Jes F Pascua
(74) *Attorney, Agent, or Firm* — Clark & Elbing LLP

(57) ABSTRACT

Embodiments include a package for containing and dispensing a product. The package includes first and second layers; a product seal zone where the first layer is joined to the second layer, the product seal zone having an inner perimeter that defines an unsealed pouch area for containing the product and an outer perimeter; and a header zone adjacent to the outer perimeter of the product seal zone. The header zone includes a first tab; a second tab; a first tab-cut in the first layer within an unsealed portion of the header zone; and a second tab-cut in the second layer within the unsealed portion of the header zone. Other embodiments are also included herein.

17 Claims, 21 Drawing Sheets

Related U.S. Application Data

(60) Provisional application No. 62/348,062, filed on Jun. 9, 2016.

(51) Int. Cl.

| | |
|---|---|
| ***B65D 75/50*** | (2006.01) |
| ***B65D 75/30*** | (2006.01) |
| ***B65D 75/52*** | (2006.01) |
| ***B65B 7/02*** | (2006.01) |
| ***B65B 9/02*** | (2006.01) |
| ***B65B 61/00*** | (2006.01) |
| ***B65B 61/06*** | (2006.01) |

(52) U.S. Cl.
CPC ..... *B65B 61/007* (2013.01); *B65B 61/06* (2013.01); *B65D 75/30* (2013.01); *B65D 75/50* (2013.01); *B65D 75/52* (2013.01); *B65D 75/5805* (2013.01); *B65D 75/5827* (2013.01)

(58) Field of Classification Search
CPC ..... B65D 75/5827; B65B 1/007; B65B 1/06; B65B 7/02; B65B 9/00; B65B 9/02
USPC ..... 383/210
See application file for complete search history.

(56) References Cited

U.S. PATENT DOCUMENTS 3,123,210 A * 3/1964 Hermanson et al. .. B65D 75/26 206/363
3,189,702 A * 6/1965 Wall ..... B29C 66/723 206/216
3,256,981 A * 6/1966 Leonardo ..... B65D 75/5855 206/484.2
3,419,137 A * 12/1968 Walck, III ..... A61B 50/30 206/364
3,595,468 A * 7/1971 Repko ..... B65D 33/22 206/0.84
3,650,391 A * 3/1972 Chung ..... B65D 75/32 206/223
3,921,805 A * 11/1975 Compere ..... B65D 75/327 206/532
4,123,840 A * 11/1978 Rumer, Jr. ..... A61B 17/3215 206/363
4,176,746 A * 12/1979 Kooi ..... B65D 75/5855 206/438
4,206,844 A * 6/1980 Thukamoto ..... A61F 15/001 206/439
4,372,098 A * 2/1983 Mason ..... B65B 9/045 401/132
4,410,089 A * 10/1983 Bortolani ..... B65B 61/02 206/461
4,485,809 A * 12/1984 Dellas ..... A61F 13/023 602/52
4,574,951 A * 3/1986 Weaver ..... B65D 75/5816 206/461
4,656,068 A * 4/1987 Raines ..... B32B 27/08 229/123.1
5,253,754 A * 10/1993 Soodak ..... A01N 1/02 206/438
5,266,371 A * 11/1993 Sugii ..... A61F 13/023 428/131
5,341,922 A * 8/1994 Cerwin ..... A61B 17/06133 206/484.2
5,391,420 A * 2/1995 Bootman ..... A45D 37/00 206/213.1
5,472,093 A * 12/1995 Nugent ..... B65B 9/02 206/484
5,511,665 A 4/1996 Dressel et al.
5,562,642 A * 10/1996 Smith ..... A61F 15/001 15/104.93
5,924,795 A * 7/1999 Thompson ..... B65D 33/2525 383/5
6,325,542 B1 * 12/2001 Komatsu ..... B65D 75/46 383/210
6,326,069 B1 * 12/2001 Barnett ..... A45D 37/00 206/229
6,568,533 B1 * 5/2003 Tanaka ..... B65D 75/30 206/484
6,945,391 B2 * 9/2005 Moodie ..... B65D 75/585 206/204
6,969,197 B2 * 11/2005 Sedley ..... A61L 2/26 206/438
7,921,999 B1 * 4/2011 Kimball ..... A61F 13/00063 206/440
8,333,510 B2 12/2012 Ackermann et al.
8,622,206 B2 1/2014 Miller et al.
9,346,601 B2 * 5/2016 Bogue ..... B32B 1/02
9,555,513 B2 * 1/2017 Schmeiser ..... B65B 9/04
2006/0023976 A1 2/2006 Alvater et al.
2008/0063325 A1 * 3/2008 Miller ..... B65D 75/20 383/211
2008/0190809 A1 8/2008 Simon et al.
2009/0283440 A1 * 11/2009 Krumme ..... B65D 75/5855 206/534.1
2010/0221313 A1 * 9/2010 Smith ..... A61K 9/7084 424/448
2010/0288770 A1 11/2010 Marco et al.
2013/0213967 A1 * 8/2013 Kroeyr ..... B65D 51/00 220/315
2013/0308882 A1 * 11/2013 Fogle ..... B65D 75/5855 383/210
2015/0336726 A1 * 11/2015 Suter ..... B32B 27/08 206/484.2
2016/0052244 A1 * 2/2016 Kuriyama ..... B32B 27/30 428/212
2016/0144603 A1 * 5/2016 Shah ..... B32B 7/02 428/35.3
2016/0296965 A1 * 10/2016 Nummila-Pakarinen ..... B32B 27/34
2016/0363970 A1 * 12/2016 Zhou ..... G06F 1/203
2017/0011949 A1 * 1/2017 Saiki ..... H01L 21/78
2017/0087814 A1 * 3/2017 Goel ..... B32B 27/32
2017/0151765 A1 * 6/2017 Ohman ..... B32B 3/26
2018/0222652 A1 * 8/2018 Berry ..... B65D 75/30

FOREIGN PATENT DOCUMENTS

| | | | |
|---|---|---|---|
| EP | 1120355 | A1 | 8/2001 |
| EP | 1985551 | A1 | 10/2008 |
| GB | 2122166 | A | 1/1984 |
| GB | 2468309 | A | 9/2010 |
| JP | 2011-509890 | A | 3/2011 |
| WO | WO-2009/090139 | A1 | 7/2009 |
| WO | WO-2015/184986 | A1 | 12/2015 |
| WO | WO-2015/197661 | A1 | 12/2015 |
| WO | WO-2016/025907 | A1 | 2/2016 |
| WO | WO-2017/066426 | A1 | 4/2017 |

OTHER PUBLICATIONS

Written Opinion for International Application No. PCT/US2017/036600, dated Oct. 4, 2017 (6 pages).
International Preliminary Report on Patentability for International Application No. PCT/US2017/036600, dated Dec. 11, 2018 (7 pages).
"Final Office Action," for U.S. Appl. No. 13/896,551, dated Jun. 15, 2016 (9 pages).
"Non-Final Office Action," for U.S. Appl. No. 13/896,551, dated Sep. 30, 2015 (12 pages).
"Response to Final Office Action," for U.S. Appl. No. 13/896,551, filed Sep. 15, 2016 (11 pages).
"Response to Non-Final Office Action," for U.S. Appl. No. 13/896,551, filed Feb. 29, 2016 (10 pages).

(56) References Cited

OTHER PUBLICATIONS

Office Action for Japanese Patent Application No. 2018-564846, dated Jun. 29, 2021 (9 pages).

* cited by examiner

EASY-OPEN PEEL POUCH

This application claims the benefit of U.S. Provisional Application No. 62/348,062, filed Jun. 9, 2016, the contents of which are herein incorporated by reference.

FIELD OF THE TECHNOLOGY

The technology described herein generally relates to a package having a pouch area. More particularly the technology described herein relates to a package where layers are peeled apart to access a pouch area.

BACKGROUND

Many different types of packages are made with two or more layers of material that are sealed together to form a pouch for containing a product, and then can be peeled apart to access the product. In some areas of technology, it is desirable to have access to products that are sterile for their eventual use. This is a common issue in the medical field, for example, where it is desirable that products used in medical procedures remain sterile over transport to and from manufacturing facilities, medical facilities, and the like, in addition to while stored in those facilities. In some package designs, it is difficult to separate the layers of package in order to grasp the layers and peel them apart. Static electricity may play a role in making the layers difficult to separate. A cutting process for cutting the outer package perimeter may fuse the layers together at their outer perimeters to some degree, which can make the layers difficult to separate.

Some packages are made with a cut or tear that enables the user to tear all layers of the package starting at the cut, in order to gain access to at least part of the pouch area containing the product. However, tearing all layers across the pouch area can cause damage to fragile contents. Also, tearing all layers across one side of a pouch area can still make it difficult to remove the contents in some situations.

Time and frustration become issues where a package requires the manual separation of thin layers to open, especially when the user has limited manual dexterity, has a disability, is wearing gloves, or is addressing an urgent medical need.

SUMMARY

Embodiments disclosed herein include a package for containing and dispensing a product. The package includes a first layer; a second layer; a product seal zone where the first layer is joined to the second layer by a peelable seal, the product seal zone having an inner perimeter that defines an unsealed pouch area for containing the product and an outer perimeter; and a header zone adjacent to the outer perimeter of the product seal zone. The header zone includes a first tab; a second tab; a first tab-cut in the first layer within an unsealed portion of the header zone; and a second tab-cut in the second layer within the unsealed portion of the header zone. In some embodiments, the first tab-cut does not intersect the second tab-cut.

In some embodiments, the first tab comprises a first tab seal zone wherein the first layer is joined to the second layer; and the second tab comprises a second tab seal zone wherein the first layer is joined to the second layer.

In some embodiments, the first tab-cut is located between the product seal zone and the first tab seal zone, and the second tab-cut is located between the product seal zone and the second tab seal zone.

In some embodiments, the first tab-cut separates a portion of the first layer from a remainder of the first layer, and wherein the second tab-cut separates a portion of the second layer from a remainder of the second layer.

In some embodiments, the package defines a void between the first tab and the second tab.

In some embodiments, the first tab-cut extends from the void to the perimeter of the package, and the second tab-cut extends from the void to the perimeter of the package.

In some embodiments, the first tab-cut extends to a first side edge of the package and the second tab-cut extends to a second side edge of the package opposite from the first side edge.

In some embodiments, the outer perimeter of the package is substantially rectangular except for a portion of the outer perimeter along one edge that extends inward towards the product seal zone to define a void between the first tab and the second tab.

In some embodiments, the void extends inward from the middle of an edge of the package.

In some embodiments, the first tab comprises a first tactile feature and the second tab comprises a second tactile feature.

In some embodiments, each of the tactile features is selected from a group consisting of: an aperture, one or more slits, grooves, bumps, and recesses.

In some embodiments, each of the tactile feature defines an aperture and further comprising a dulling element along a portion of an aperture edge, wherein the dulling element includes a folded portion of at least one of the first or second layer.

In some embodiments, the first tactile feature is located within the first tab seal zone, and the second tactile feature is located within the second tab seal zone. In some embodiments, the first tactile feature is identical to the second tactile feature.

In some embodiments, there is no cut in the second layer at a location corresponding to the first tab-cut on the first layer. In some embodiments, there is no cut in the first layer at a location corresponding to the second tab-cut on the second layer.

In some embodiments, the product is a sheet product.

In some embodiments, the portions of the package that are located on either side of the first tab-cut are unsealed, and the portions of the package that are located on either side of the second tab-cut are unsealed.

In some embodiments, the first layer is coextensive with the second layer so that the first layer and second layer share a common outer perimeter.

In some embodiments, the unsealed portion between the product seal zone and the first tab seal zone and the second tab seal zone extends across the package from one edge of a package perimeter to an opposite edge of the package perimeter. In some examples, this unsealed portion of the header defines a chevron shape. In some examples, the outer perimeter of the product seal zone defines a first chevron shape. In some examples, the inner perimeter of the product seal zone defines a second chevron shape. In some examples, the angle of the first chevron shape is equal to the angle of the second chevron shape. In some examples, the angle of the second chevron shape is smaller than the angle of the first chevron shape. In some examples, the chevron shape defines an angle of between 90 degrees and 130 degrees. In some examples, the chevron shape defines an angle of between 110 degrees and 125 degrees.

In some embodiments, the unsealed pouch area is a pentagon shape.

In some embodiments, the product seal zone is pointed towards a void located between the first tab and the second tab.

In some embodiments, the first tab-cut is parallel with a portion of the product seal zone and the second tab-cut is parallel with a portion of the product seal zone.

In some embodiments, the first tab-cut is not parallel with the second tab-cut.

In some embodiments, an edge of the first tab seal zone is parallel with the first tab-cut, and an edge of the second tab seal zone is parallel with the second tab-cut.

In some embodiments, the package has a length of at least 2 inches and not more than 6 inches. In some embodiments, the package has a width of at least 1 inch and not more than 3 inches. In some embodiments, the length of the package is about 4 inches and the width of the package is about 2 inches.

Embodiments disclosed herein include a package for containing and dispensing a product. The package includes a first layer; a second layer; a product seal zone where the first layer is joined to the second layer by a peelable seal, the product seal zone having an inner perimeter that defines an unsealed pouch area for containing the product and an outer perimeter; and a header zone adjacent to the outer perimeter of the product seal zone. The header zone includes a first tab comprising a first tab seal zone wherein the first layer is joined to the second layer; a second tab comprising a second tab seal zone wherein the first layer is joined to the second layer; a first tab-cut in the first layer within an unsealed portion of the header zone; and a second tab-cut in the second layer within the unsealed portion of the header zone. In some embodiment, the package defines a void between the first tab and the second tab.

Embodiments disclosed herein include a package for containing and dispensing a product. The package includes a first layer; a second layer; a product seal zone where the first layer is joined to the second layer by a peelable seal, the product seal zone having an inner perimeter that defines an unsealed pouch area for containing the product and an outer perimeter; and a header zone adjacent to the outer perimeter of the product seal zone. The header zone includes a first tab that has a first tab seal zone wherein the first layer is joined to the second layer; a second tab that has a second tab seal zone. In some examples, the first layer is joined to the second layer, a first tab-cut in the first layer is located within an unsealed portion of the header zone, and a second tab-cut in the second layer is located within the unsealed portion of the header zone. In some embodiments, the first tab-cut only extends through the first layer and does not extend through the second layer, and the second tab-cut only extends through the second layer and does not extend through the first layer.

In some examples, in the product seal zone the first layer is joined to the second layer by a peelable seal.

In some examples, the first tab-cut and the second tab-cut are both located in an unsealed area of the package. In some examples, the first tab comprises a first tab seal zone wherein the first layer is joined to the second layer, and an unsealed portion between the product seal zone and the first tab seal zone and the second tab seal zone extends across the package from one edge of a package perimeter to an opposite edge of the package perimeter.

In some examples, the second tab includes a second tab seal zone in which the first layer is joined to the second layer. In some examples, the first tab-cut extends from the void across a portion of the package to the perimeter of the package, and the second tab-cut extends from the void across a portion of the package to the perimeter of the package.

In some examples, the first tab-cut extends to a first side edge of the package and the second tab-cut extends to a second side edge of the package opposite from the first side edge.

In some examples, the first tab has a first tactile feature and the second tab has a second tactile feature. In some examples, each of the tactile features is selected from a group consisting of an aperture, one or more slits, grooves, bumps, and recesses. In some examples, each of the tactile feature defines an aperture. In some examples, the tactile feature has a dulling element along a portion of an aperture edge, and the dulling element includes a folded portion of at least one of the first or second layer.

In some examples, there is no cut in the second layer at a location corresponding to the first tab-cut on the first layer and there is no cut in the first layer at a location corresponding to the second tab-cut on the second layer. In some examples, the first layer is coextensive with the second layer so that the first layer and second layer share a common outer perimeter.

In some examples, the first tab-cut is parallel with a portion of the product seal zone and the second tab-cut is parallel with a portion of the product seal zone.

In some examples, there is an unsealed portion between the product seal zone and the first tab seal zone, and there is an unsealed portion between the product seal zone and the second tab seal zone. In some examples, the unsealed portion is contiguous. In some examples, the unsealed portion extends across the package from one edge of a package perimeter to an opposite edge of the package perimeter. In some examples, the first tab-cut is not parallel with the second tab-cut.

In some examples, the package further includes a first score in the first layer and a second score in the second layer, and the first score is parallel to the second score. In some examples, the first score and the second score each extend from one end of the package to an opposite end of the package.

In some examples, the package further includes a third score in the first layer and a fourth score in the second layer. In some examples, the first tab-cut extends from the void to the first score and the second tab-cut extends from the void to the second score.

In some examples, the product seal zone includes a peel brake feature, and the product seal zone requires a user to apply more force to separate the first layer from the second layer at the peel brake feature than along a portion of the product seal zone adjacent to the peel brake feature.

In some examples, the peel brake feature includes a peel interrupt feature that impedes the separation of the first layer from the second layer, and the peel interrupt feature includes at least one from the group comprising: a crimp, a cut in at least one of the first layer and the second layer, an edge-cut in at least one of the first layer and the second layer that starts at the outer perimeter, a notch, a weld, and an ultrasonic weld.

In some examples, the product seal zone has a variable width that varies along a side edge of the package, and the variable width comprises a first width at a first portion of the product seal zone and a second width greater than the first width at a second portion of the product seal zone. In some examples, the first portion of the product seal zone is closer to the header zone than the second portion, and the variable width along the side edge requires a user to apply increased force to separate the first layer from the second layer at an end of the package opposite the header zone.

In some examples, a portion of the product seal zone that is adjacent to a top seal zone requires less force to separate the first layer from the second layer than a portion of the product seal zone that is on the opposite end of the package from the header zone.

In some examples, a method of forming a package for containing and dispensing a product is disclosed. The method includes providing a first layer web and a second layer web, placing a product on at least one pouch area of one of the first and second layer webs, forming a combined web by sealing the first layer web to the second layer web at least at a product seal zone so that the first layer is joined to the second layer by a seal surrounding the at least one pouch area, and leaving an unsealed header zone adjacent to an outer perimeter of the product seal zone where the first layer web is not sealed to the second layer web, and cutting at least one individual package around an outer package perimeter to separate the individual package from the combined web. In some examples, the step of cutting further includes cutting the first layer of the package at a first tab-cut location within the unsealed header zone to define a boundary of a first tab zone in the package, and cutting the second layer of the package at a second tab-cut location within the unsealed header zone to define a boundary of a second tab zone in the package.

In some examples, the method further includes scoring the first layer and the second layer. In some examples, the scores in the first layer and the second layer each cross a portion of the product seal zone and a portion of the pouch area. In some examples, forming a combined web further includes sealing the first layer web to the second layer web at a first tab seal zone which is within the first tab zone, and sealing the first layer web to the second layer web at a second tab seal zone which is within the second tab zone. In some examples, the step of cutting further includes cutting the first layer and the second layer of the package to define a void between the first tab zone and the second tab zone.

This summary is an overview of some of the teachings of the present application and is not intended to be an exclusive or exhaustive treatment of the present subject matter. Further details are found in the detailed description and appended claims. Other aspects will be apparent to persons skilled in the art upon reading and understanding the following detailed description and viewing the drawings that form a part thereof, each of which is not to be taken in a limiting sense. The scope of the present application is defined by the appended claims and their legal equivalents.

BRIEF DESCRIPTION OF THE FIGURES

The technology may be more completely understood in connection with the following drawings, in which.

Figure 1:
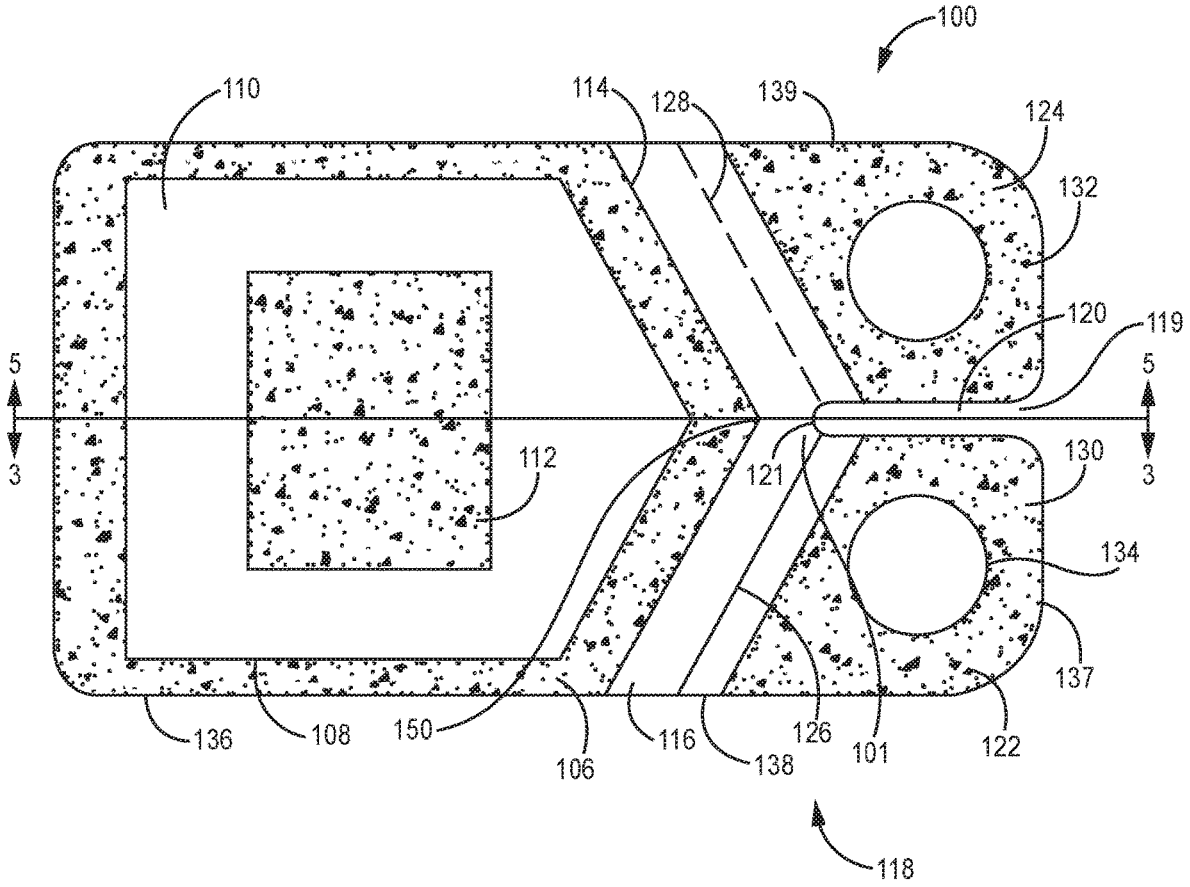
FIG. 1 is a front view of a package with a first tab and a second tab, according to some embodiments.

While the technology is susceptible to various modifications and alternative forms, specifics thereof have been shown by way of example and drawings, and will be described in detail. It should be understood, however, that the application is not limited to the particular embodiments described. On the contrary, the application is to cover modifications, equivalents, and alternatives falling within the spirit and scope of the technology.

DETAILED DESCRIPTION

The package described herein is generally configured to contain and dispense a product. The product can be medical in nature and can be related to surgical needs, pharmaceutical needs, medical emergency responder needs, and the like. In some embodiments the product is a wound dressing, a medical care product, a medical device, and the like. In some embodiments the product is a sheet product such as a soluble film that can be relevant to edible applications, oral applications, skin care applications, cosmetic applications, and the like. A sheet product generally is very thin and has width and length dimensions that are significantly larger than its thickness dimension, such as where the width and length are at least ten times the thickness dimension, or where the width and length are at least one-hundred times the thickness dimension. Sheet products sometimes have parallel sides. In some cases, a wound dressing is a sheet product. In some embodiments, the product can include a part or object intended to be consumed by a person, such as a pill or a tablet. In other embodiments, the product can include a part or object that is not intended to be consumed by a person.

Generally the package can include a first layer and a second layer. The first layer can be overlaid on top of the second layer. The first layer and the second layer can be coextensive with the second layer so that the first layer and the second layer share a common outer perimeter.

Some portions of the first layer can be sealed or joined with corresponding portions of the second layer to define one or more seal zones. Some portions of the first layer can remain separate, unsealed, or not joined with the second layer to define one or more unsealed zones. In some examples, a product seal zone is a portion in which the first layer and the second layer are sealed together. The product seal zone encloses an unsealed package zone in which a product can be placed. The product seal zone protects the unsealed package zone from exposure.

The package can further include one or more tabs in a header zone. In some examples, the first layer and the second layer are sealed together at a first area to create a first tab, and sealed together at a second area to create a second tab. The first tab and the second tab can be separated from the product seal zone by an unsealed portion of the package. The unsealed portion of the package can extend from a first edge of the package to a second edge of the package opposite the first edge. The first tab and the second tab can be separated by an edge of the package that defines a void between the first tab and the second tab.

In some examples, the package includes a first tab-cut on a first side of the package (for example, the front of the package) and a second tab-cut on the opposite side of the package (for example, the back of the package). The first tab-cut is a cut through the first layer of the package that does not reach the second layer of the package. The second tab-cut is a cut through the second layer of the package that does not reach the first layer. In some examples the first tab-cut and the second tab-cut do not overlap.

In some examples, the first tab-cut begins at a first edge of the package and ends at an edge of the package defining the void between the first tab and the second tab. In some examples, the second tab-cut begins at a second edge of the package opposite the first edge of the package, and ends at the edge of the package defining the void between the first tab and the second tab. In some examples, the first tab-cut does not intersect the second tab-cut. In some examples, the first tab-cut and the second tab-cut are both located in the unsealed portion of the package. In some examples, the first tab-cut is parallel to a first edge of the product seal zone and the second tab-cut is parallel to a second edge of the product seal zone. In some examples, the first tab-cut is not parallel to the second tab-cut.

The first and second tabs can include one or more tactile features. The tactile features can be physical features located on a tab that allow the package to be easier to open, such as by decreasing the likelihood that a user's fingers will slip or slide on the tab, or by helping the user to identify the location of the tabs and the best location for grasping the product during opening. For example, the tactile feature can be an aperture, one or more slits, grooves, bumps, or recesses. The tactile feature can define an aperture with a dulling element along a portion of the edge of the aperture that prevents a user from encountering a sharp edge on the edge of the aperture.

The package functions by allowing a user to open the package by gripping the first and second tabs and pulling the tabs in opposite directions. The seal is broken when the first layer is peeled apart from the second layer. Pulling the tabs apart causes the first layer to separate from the second layer by breaking the seal between the first layer and the second layer in the product seal zone. In some examples, the product seal zone has an apex in the shape of a chevron.

Pulling the first and the second tabs apart causes the seal to be broken first at the apex of the product seal zone. Wide seal areas require more force to break the seal than narrow seal areas. At the apex, the width of the seal is narrow. The narrow chevron shape requires relatively little force to overcome the seal. The force needed to peel the first layer apart from the second layer increases as the seal gets wider across with width of the pouch at the portion of the product seal zone adjacent to the unsealed area of the header zone. Eventually, pulling the first and second tabs farther and farther apart causes the side edge portions of the product seal zone to become unsealed, which exposes the product contained within the unsealed area of the product pouch.

The package can define a peel brake feature. The peel brake can impede the first layer from separating from the second layer. The peel brake feature can prevent the first layer and the second layer from separating at a back edge of the package opposite the header zone. The peel brake feature is useful to prevent the product inside the product pouch from falling out of the package when the package is opened.

The peel brake feature can include an area of the product seal zone having an increased width, or a width that varies between a wide width and a narrow width. The wider width of the product seal zone increases the resistance of the seal from being broken. This can slow down the speed at which the first layer and the second layer are pulled apart. The inner perimeter of the product seal zone can define a shape that gives the product seal zone a changing width as the first and second layers are peeled apart. For example, the side edges of the product seal zone can have a first width near the header zone, and can have an increased width nearer the end of the package opposite the header. The side edge of the product seal zone can have a third width at the end of the package opposite the header. The third width can be the same width as the width of the side edge of the product seal zone that is nearest the header zone.

The package can also include one or more scores in the package. For example, the package can have a first score in the first layer and a second score in the second layer. The first score can be parallel to the second score, and can extend from one end of the package to the other end. The score can aid in separating the first and second layers of the package when opening the package. The package can also include a third score in the first layer and a fourth score in the second layer. The first and second tab-cuts can intersect one or more of the scores.

In other examples, the peel brake feature includes a peel interrupt feature. The peel interrupt feature provides increased resistance to the seal being broken. The peel brake feature requires a user to apply increased force to separate the first layer from the second layer. In some examples, the peel interrupt feature prevents the seal from being broken altogether at the location of the peel interrupt feature. In other examples, the peel interrupt feature changes the way that the first layer separates from the second layer at the location of the peel interrupt feature. In each case, the peel interrupt feature provides tactile feedback to the user to slow down or to stop peeling apart the first and second layers. When the first tab and the second tab are pulled far enough apart that the peel brake feature is activated, the user can remove the product from the unsealed pouch area. The peel interrupt can include a crimp, a cut in one or both of the first and second layers, an edge-cut, a notch, an ultrasonic weld, or a weld.

The various embodiments also include a method for forming a package. The method includes providing a first layer web and a second layer web, placing a product on a pouch area on one of either the first layer web or the second layer web, forming a combined web by sealing the first layer to the second layer at a product seal zone such that the first layer is joined to the second layer by a seal surrounding the pouch area, and leaving an unsealed header zone adjacent to the outer perimeter of the product seal zone. The first layer web is not sealed to the second layer web in the unsealed header zone. An individual package is cut around an outer package perimeter to separate the individual package from the combined web. The cutting further includes cutting the first layer at a first tab-cut location within the unsealed header zone to define a boundary of a first tab zone in the package. The cutting also includes cutting the second layer at a second tab-cut location within the unsealed header zone to define a boundary of a second tab zone in the package. In some embodiments, the first layer and the second layer are scored, and the first and the second scores each cross a portion of the product seal zone and a portion of the pouch area. In some examples, forming the combined web includes sealing the first layer web to the second layer web at a first tab seal zone and a second tab seal zone. The first layer and the second layer can also be cut to define a void between the first tab zone and the second tab zone.

In reference now to the figures, FIG. 1 shows a front view of a package 100, according to some embodiments. The package can include a first layer 202 and a second layer. The second layer 204 is not shown in FIG. 1 but can be seen in FIGS. 2-6. The first layer 202 can be located on top of the second layer 204. In various embodiments, the first layer 202 is coextensive with the second layer 204, such that the first layer 202 and second layer 204 share a common outer perimeter 136. In various embodiments, the first layer 202 has the same outer perimeter as the second layer 204, such that the two layers 202, 204 have the substantially the same shape and size. The layers 202, 204 can be substantially the same shape and size, such that they are both within a reasonable range of manufacturing tolerances.

The first layer 202 can be joined with the second layer 204 in one or more seal zones. In some embodiments the package 100 includes a product seal zone 106. An inner perimeter 108 of the product seal zone 106 can define an unsealed pouch area 110. The unsealed pouch area 110 can be configured to house or store the product 112 within the package 100. As discussed above, the product 112 can include a sheet product. In some embodiments, the unsealed pouch area 110 can be a pentagon shape, such as an irregular pentagon shape, as shown in FIG. 1. In some embodiments, portions of the product seal zone 106 can be pointed or angled towards the void 120 located between the first tab 122 and the second tab 124. A product seal zone 106 can be pointed or angled towards the header zone 118 or towards the end of the package 100 that a user will start opening the package from. A pointed or angled apex 101 of product seal zone 106 allows the user to use a smaller amount of force to break the seal because a smaller area of the seal resists the seal being broken at the apex 101 compared to other portions of the product seal zone 106. In addition to being angled or pointed at apex 101, the product seal zone 106 can be curved or stepped such that the portion of the peelable seal that is first broken requires less force to separate the first layer 202 from the second layer 204 than subsequent portions of the peelable seal.

The product seal zone 106 can include an area in which the first layer 202 is joined to the second layer 204 by a peelable seal. The peelable seal can secure the two layers 202, 204 together until they are peeled apart, such as to provide access to the product 112 within the unsealed pouch area 110. In some embodiments, the first layer 202 and the second layer 204 can be fused together in the product seal zone 106.

The outer perimeter 114 of the product seal zone 106 can be in part located along the perimeter of the package 100. A portion of the outer perimeter 106 of the product seal zone 106 can be located within the outer perimeter of package 100, such as extending across an inner portion of the package 100. In some embodiments, a portion of the outer perimeter 114 of the product seal zone 106 can be adjacent to an unsealed portion 116, such as a portion of the header zone 118.

The package 100 can include a header zone 118. The header zone 118 can refer to a portion of the package 100 which does not contain the product 112. The header zone 118 can refer to a portion of the package 100 which enables the user to easily open the package 100 to access the product 112. The header zone 118 can include a void 120, a first tab 122, a second tab 124, a first tab-cut 126, and a second tab-cut 128.

In some embodiments, the package 100 defines a void 120 between the first tab 122 and the second tab 124. In various embodiments, the header zone 118 can define a void 120. The void 120 can extend from the generally rectangular shape of the package 100 inward towards the center of the package 100, such as towards the unsealed pouch area 110 or the product seal zone 106. The outer perimeter of the package can extend inwards towards the center of the package 100 to define the void. In some embodiments, the outer perimeter of the package 100 extends inwards between the two tabs 122, 124 to define a void 120 that separates the tabs 122, 124 from each other. In some embodiments, the void 120 extends inward from the middle of an edge 137 of the package 100, such as equal distance between the first edge 138 and the second edge 139. In some embodiments, the void 120 extends past a portion of the first tab seal zone 130 and a portion of the second tab seal zone 132. In some embodiments, the void 120 terminates within the header zone 118, such as in an unsealed portion 116 of the header zone 118. The void 120 can be located between the first tab 122 and the second tab 124.

In some embodiments, the void 120 has an open end 119 and a closed end 121, where the closed end 121 is closer to the product seal zone 106 than the open end 119. In some embodiments, the closed end 121 includes a curved edge, a chevron edge, or a squared-off edge.

The first tab 122 and second tab 124 can each be held by a user when opening the package 100. The first tab 122 can be pulled or forced in a direction opposite from the second tab 124 to break a portion of the peelable seal by separating the layers from each other. Separating the layers from each other allows a user to open the package 100 and gain access to the product within the unsealed pouch area. In some embodiments, the package 100 can be opened by separating the first layer 202 from the second layer 204 such as by peeling one of the layers away from the other layer. The peelable seal areas can be configured to have the two layers joined until one layer is peeled away from the other layer. The peelable seal areas can be configured such that when the first layer is separated from the second layer, the seal is broken but each of the layers remain relatively intact.

The first tab-cut 126 can be a cut or separation in the first layer 202. The first tab-cut 126 can define a boundary for the first tab 122 from the remainder of the header zone 118. In some embodiments, the first tab-cut 126 is located between the product seal zone 106 and the first tab seal zone 130. In some embodiments, the portions of the package 100 that are located on either side of the first tab-cut 126 are unsealed. The first tab-cut 126 can separate a portion of the first layer 202 from another portion of the first layer 202. In some embodiments, the first tab-cut 126 only extends through the first layer 202 and not through or into the second layer 204. In some embodiments, the first tab-cut 126 extends completely through the first layer 202 and not into the second layer 204. In some embodiments, there is no cut in the second layer 204 at a location corresponding to the first tab-cut 126 on the first layer 202. The first tab-cut 126 can extend from the outer perimeter of the package 100 inwards. In various embodiments, the first tab-cut 126 terminates at the void 120. In some embodiments, the first tab-cut 126 extends from the outer perimeter of the package 100 to the void 120.

In some embodiments, the first tab-cut 126 is a continuous cut through the first layer 202 along its length, as shown in FIG. 1. In some embodiments, the first tab-cut 126 is a perforation cut line, such as a series of small cuts in a line.

The first tab 122 can include a first tab seal zone 130. The first tab seal zone 130 can include an area in which the first layer 202 is joined to the second layer 204 by a seal, such as a peelable seal. In some embodiments, the first tab seal zone 130 can include an area in which the first layer 202 is joined to the second layer 204 by a non-peelable seal, such that the first layer 202 and the second layer 204 are permanently joined or unable to be separated without destroying at least a portion of at least one of the two layers 202, 204. In some embodiments, an unsealed area can separate the first tab seal zone 130 from the first tab-cut 126.

The second tab-cut 128 can be a cut or separation in the second layer 204. The second tab-cut 128 can define a boundary for the second tab 124 from the remainder of the header zone 118. In some embodiments, the second tab-cut 128 is located between the product seal zone 106 and the second tab seal zone 132. In some embodiments, the portions of the package 100 that are located on either side of the second tab-cut 128 are unsealed. The second tab-cut 128 can separate a portion of the second layer 204 from another portion of the second layer 204. In some embodiments, the second tab-cut 128 only extends through the second layer 204 and not through or into the first layer 202. In some embodiments, the second tab-cut 128 extends completely through the second layer 204 and not into the first layer 202. In some embodiments, there is no cut in the first layer 202 at a location corresponding to the second tab-cut 128 on the second layer 204. The second tab-cut 128 can extend from the outer perimeter of the package 100 inwards. In various embodiments, the second tab-cut 128 terminates at the void 120. In some embodiments, the second tab-cut 128 extends from the outer perimeter 136 of the package 100 to the void 120. In some embodiments, the first tab-cut 126 and the second tab-cut 128 extend to opposite edges of the perimeter of the package 100. In some embodiments, the first tab-cut 126 extends to a first side edge 138 of the package 100 and the second tab-cut 128 extends to a second side 139 edge of the package 100 opposite from the first side edge 138. In some embodiments, the first tab-cut 126 and the second tab-cut 128 extend from opposite sides of the void 120 to corresponding opposite edges of the perimeter of the package 100.

FIG. 1 shows second tab-cut 128 as a dashed line because it is present in the second layer 204 and is therefore not visible from the front view perspective of FIG. 1. In the embodiment of FIG. 1, the second tab-cut 128 is a continuous cut through the second layer 204 along its length. In some embodiments, the second tab-cut 128 is a perforation cut line in the second layer 204, such as a series of small cuts in a line.

In various embodiments, the first tab-cut 126 is not parallel with the second tab-cut 128. In various embodiments, the first tab-cut 126 does not intersect the second tab-cut 128. In various embodiments, the first tab-cut 126 does not cross over or intersect the second tab-cut 128. In various embodiments, the first tab-cut 126 is in a different plane than the second tab-cut 128.

The second tab 124 can include a second tab seal zone 132. The second tab seal zone 132 can include an area in which the first layer 202 is joined to the second layer 204 by a seal, such as a peelable seal. In some embodiments, the first layer 202 is joined to the second layer 204 by a non-peelable seal in the second tab seal zone 132. In some embodiments, an unsealed area can separate the second tab seal zone 132 from the second tab-cut 128. In some embodiments, the unsealed portion between the product seal zone 106 and the first tab seal zone 130 and the second tab seal zone 132 extends across the package from one edge of the package perimeter to an opposite edge of the package perimeter.

In some embodiments, an edge of the first tab seal zone 130 is parallel with the first tab-cut 126. In some embodiments, an edge of the second tab seal zone 132 is parallel with the second tab-cut 128. In some embodiments, the first tab-cut 126 is parallel with a portion of the product seal zone 106. In some embodiments, the second tab-cut 128 is parallel with a portion of the product seal zone 106.

In some embodiments, the package 100 can include a first tab seal zone 130 and not include a second tab seal zone 132. In some embodiments, the package 100 can include a second tab seal zone 132 and not include a first tab seal zone 130. In some embodiments, the package 100 can include both a first tab seal zone 130 and a second tab seal zone 132. In some embodiments, the package 100 does not include a seal zone on either the first tab 122 or the second tab 124.

Figure 8:
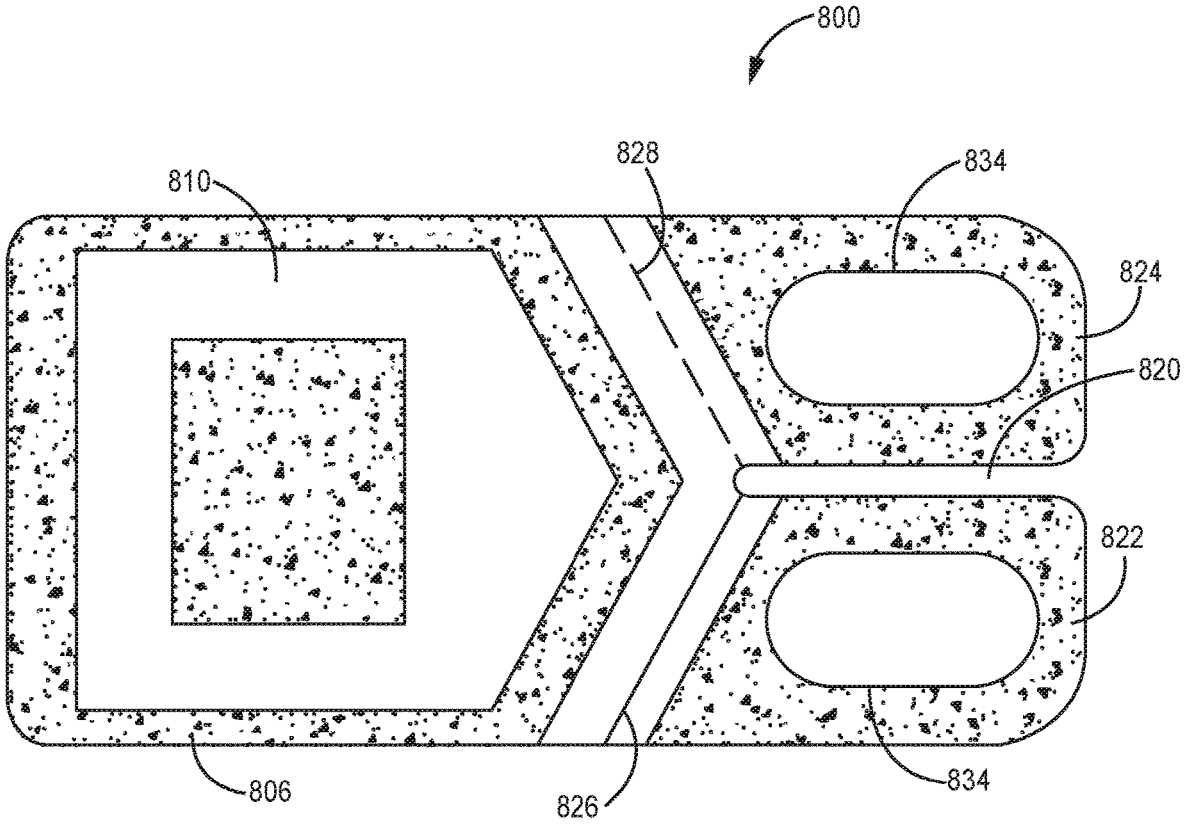
FIG. 8 is a front view of a package with a different embodiment of the tactile feature.

In various embodiments, the package 100 can include one or more tactile features 134. In some embodiments, the first tab 122 and the second tab 124 each include a tactile feature 134. A tactile feature 134 can be a physical deviation or change in the package 100 from the remainder of the tab in which it is located. The tactile feature 134 can aid the user in grasping the first tab 122 or the second tab 124, such as while opening the package. In some embodiments, a tactile feature 134 is selected from a group consisting of apertures, slits, grooves, bumps, recesses, dimples, ridges, and projections. A tactile feature 134 can include a raised portion of the package, such as a ridge, a dimple, or a projection. A tactile feature 134 can include a cut or a slit, such as a cut that goes through both the first layer 202 and the second layer 204. In various embodiments, a slit or cut can include only separating adjacent material in the package (such as in the first tab 122 or the second tab 124) without removing material, such that the slit or cut can be a line and not have any substantial area. In some embodiments, a tactile feature 134 can include an indented or removed portion of the package. In some embodiments, only a portion of the package 100 is removed, such as to define one or more trenches, grooves, or depressions in the first tab 122 or second tab 124. In some embodiments, a portion of the package 100 is completely removed, such as to form a through hole or an aperture. A through hole or aperture can take the form of many different shapes, such as a circle (as shown in FIG. 1) or an oval (as shown in FIG. 8). Other shapes are also possible, such as a square, a rectangle, a triangle, or an irregular shape.

In some embodiments, the first tab 122 can include a tactile feature 134, such as the tactile feature 134 can be located within the first tab seal zone 130. In some embodiments, the second tab 124 can include a tactile feature 134, such as a tactile feature 134 located within the second tab seal zone 132. In various embodiments, the first tab tactile feature 134 can be identical to the second tab tactile feature 134.

Figure 2:
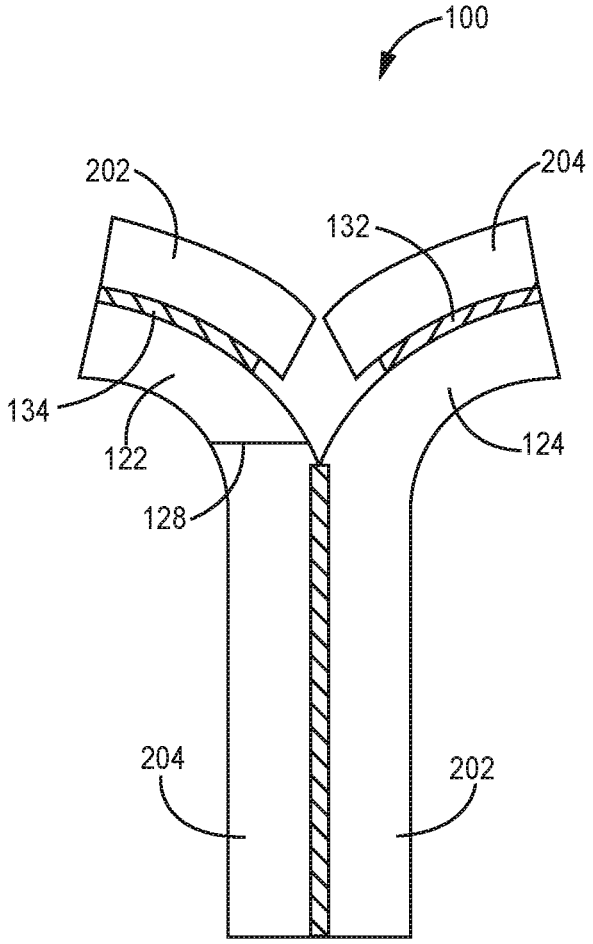
FIG. 2 is a side view of the package of FIG. 1 with the first and second tabs starting to be pulled in opposite directions.

FIG. 2 shows a side view of a package 100 being opened, according to an embodiment. A user can open the package 100 to gain access the product. To open the package 100, a user can separate the first layer 202 from the second layer 204. A user can grasp or hold the first tab 122 with one hand and the second tab 124 with the other hand. In various embodiments, the user grasps or holds the tactile feature 134 on each tab. The user can separate the layers by pulling the first tab 122 in a first direction and pulling the second tab 124 in a second direction. The first direction can be opposite from the second direction, such that the user pulls the first tab 122 away from the second tab 124. Pulling the tabs 122, 124 in opposite directions can break at least a portion of the peelable seal in the product seal zone 106 and separate the first layer 202 from the second layer 204. A product seal zone 106 that is pointed or angled towards the header zone 118, as shown in the example of FIG. 1, can reduce the amount of force the user needs to apply to separate the first layer 202 from the second layer 204 as compared to a non-pointed or non-angled seal zone, or a seal zone that extends straight across the package from side to side. The force required to separate the layers can be a result of starting by only separating the portions at the tip of the point or angle as opposed to separating a sealed area the extends across the package perpendicular to the direction of layers being separated. Once the first layer 202 is at least partially separated from the second layer 204, the user can gain access to the unsealed pouch area 110, such as to pick up and remove the product from the package 100.

As shown in FIG. 2, the majority of first layer 202 can be separated from the majority of the second layer 204 by pulling the tabs 122, 124 in opposite directions and breaking the seal in the product seal zone 106. A portion of the second layer 204 can remain joined with the first layer 202, such as the portion of the second layer 204 that is a part of the second tab 124. Similarly, a portion of the first layer 202 can remain joined with the second layer 204, such as the portion of the first layer 202 that is a part of the first tab 122. Further, the portion of the product seal zone 106 that is on the opposite end of the package from the header zone 118 can remain intact when the package 100 is opened. As such, the first layer 202 can remain joined with the second layer 204 along a portion of the product seal zone 106 when the package 100 is opened.

In order to aid the user in opening the package 100, in some embodiments, indicia can be printed on one or both of the layers 202, 204 to indicate how to open the package. In some embodiments, the indicia can include information relating to which direction each tab should be pulled to open the package. In some embodiments, a portion of a layer or tab can be colored to indicate the direction the tab should be pulled.

FIGS. 3-6 are schematic cross-sectional side views of the package 100 to aid in explaining the relationship of the layers, product, seal zones and unsealed areas, and are not drawn to scale. For example, in FIGS. 3-6, the unsealed product area 110 and the unsealed header portion 116 are depicted as having a gap between the first and second layers in order to portray that there is no seal between the two layers these areas. But in reality the first and second layers will likely be in contact with each other, though not sealed to each other, in the unsealed product area 110 (except where the product 112 intervenes) and in the unsealed header portion 116. In the schematic drawings of FIGS. 3-6, the product seal zone 106 appears to be a separate structure for ease of understanding, but in reality this represents a bond between the layers that is not a separate structure.

Figure 3:
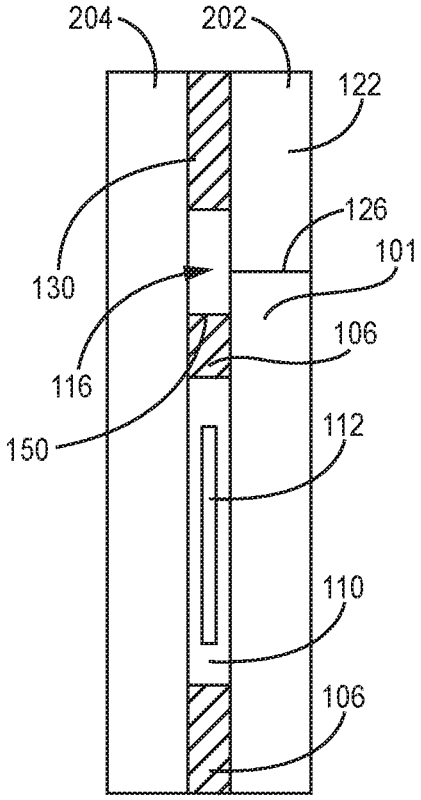
FIG. 3 is a cross-sectional side view of the package of FIG. 1 taken along line 3-3.

FIG. 3 is a cross-sectional side view of the package 100 taken along line 3-3 in FIG. 1, according to an embodiment. The first layer 202 can be aligned with the second layer 204, such that both layers 202, 204 have the same outer boundary. In various embodiments, the first layer 202 can have the same dimensions as the second layer 204. In some embodiments, the first layer 202 can include the same material(s) as the second layer 204. In some embodiments, the first layer 202 can have the same shape as the second layer 204. In some embodiments, the first layer 202 can have the same thickness as the second layer 204. In various embodiments, the first layer 202 can be substantially identical with the second layer 204. FIG. 3 shows the first tab-cut 126 in the first layer 202. The second tab-cut 128 is not shown because the cross-sectional side view of FIG. 3 is facing toward the first tab side of the package. In this view, the product seal zone 106 is viewed as a sliced cross-section, while the first tab seal zone 130 is seen from a side view. A first border portion 101 in the first layer 202 becomes detached from the first tab 122 when the first tab-cut 126 is made in the first layer 202 during the manufacturing process. But the first border portion 101 is contiguous with the second tab 124 (not seen in FIG. 3) because the first layer 202 and the second layer 204 are sealed together in the second tab seal zone 132.

Figure 4:
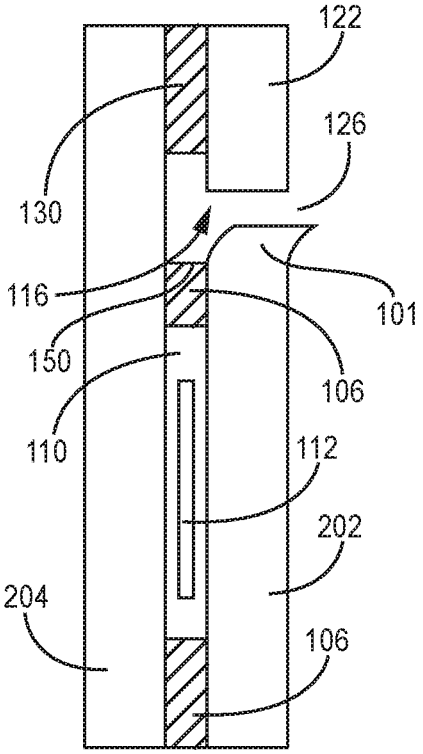
FIG. 4 is the cross-sectional side view of the package in FIG. 3 with the tab being pulled in order to start opening the package.

FIG. 4 shows the cross-sectional side view of FIG. 3 as the package is being opened. From the perspective of FIG. 4, the second tab 124 (not seen) is being pulled away in the opposite direction from the first tab 122. The first border portion 101 is pulled away from the first tab 122 by the force of the second tab 124 because the first border portion 101 is contiguous with the second tab 124. When a sufficient amount of force is applied by the user to pull the second tab 124 away from the first tab 122, the seal will be broken at the apex 150 of the product seal zone 106.

Figure 5:
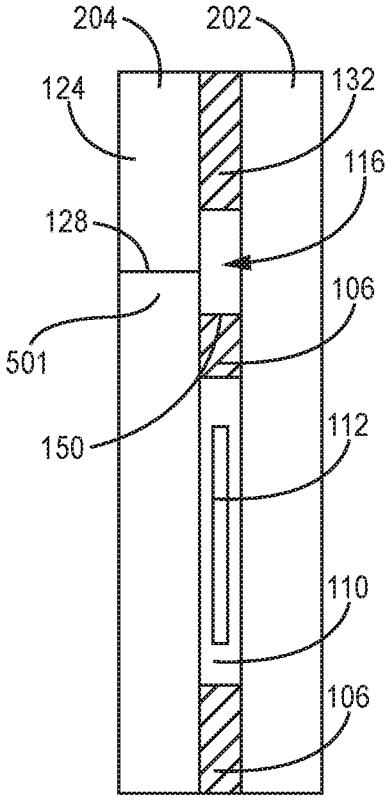
FIG. 5 is a cross-sectional side view of a package taken along line 5-5 in FIG. 1.

FIG. 5 shows the opposite view of FIG. 3. FIG. 5 shows a cross-sectional side view of the package taken along line 5-5 in FIG. 1. FIG. 5 shows the second tab-cut 128 in the second layer 204. FIG. 5 further shows the second tab 124 above the second tab-cut 128. The first tab-cut 126 is not shown because the cross-sectional side view of FIG. 5 is facing toward the second tab side of the package. In this view, the product seal zone 106 is viewed as a sliced cross-section, while the second tab seal zone 132 is seen from a side view. A second border portion 501 in the second layer 204 is similar to the first border portion 101 seen in FIG. 3. The second border portion 501 becomes detached from the second tab 124 when the second tab-cut 128 is made in the second layer 204 during the manufacturing process. The second border portion 501 is contiguous with the first tab 122 (not seen in FIG. 5) because the first layer 202 and the second layer 204 are sealed together in the first tab seal zone 130.

Figure 6:
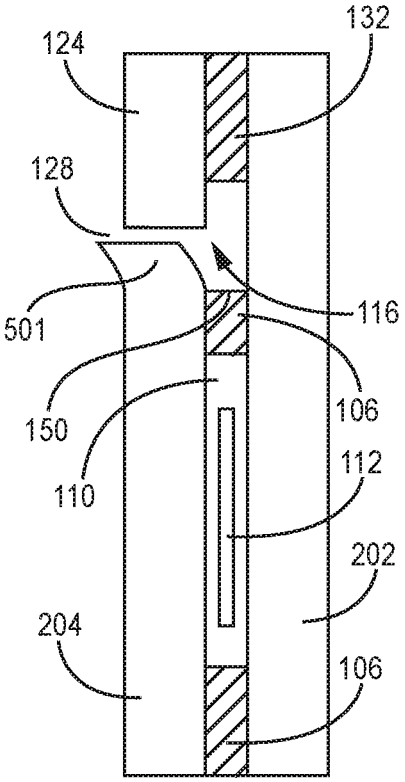
FIG. 6 is a cross-sectional side view of the package in FIG. 5 with the tab being pulled in order to start opening the package.

FIG. 6 shows the cross-sectional side view of FIG. 5 as the package is being opened, similar to FIG. 4. From the perspective of FIG. 6, the first tab 122 (not seen) is being pulled away in the opposite direction from the second tab 124. The second border portion 501 is pulled away from the second tab 124 by the force of the first tab 122 because the second border portion 501 is contiguous with the first tab 122. When a sufficient amount of force is applied by the user to pull the first tab 122 away from the second tab 124, the seal will be broken at the apex 150 of the product seal zone 106.

Figure 7:
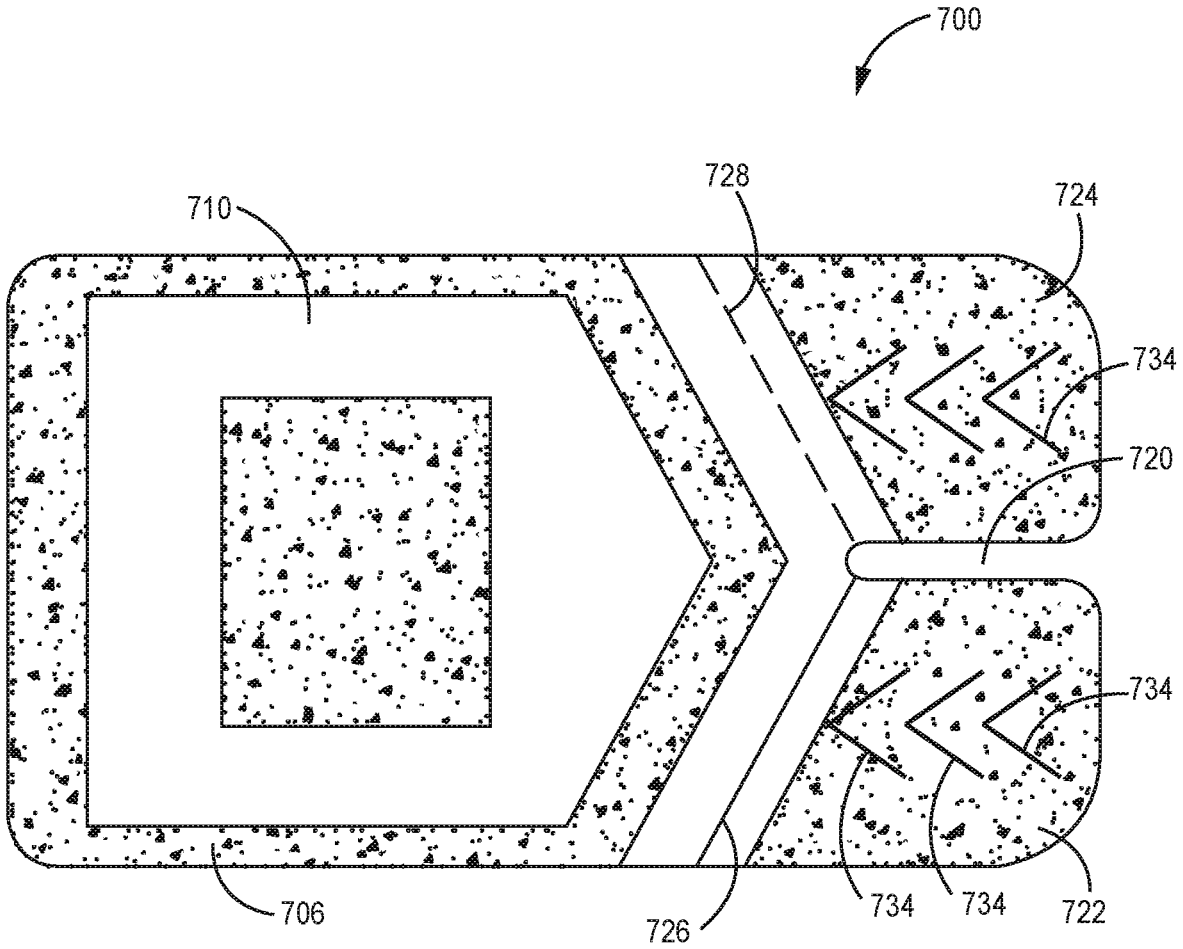
FIG. 7 is a front view of a package with a different embodiment of the tactile feature.

FIG. 7 shows a front view of a package 700, according to an embodiment. The package 700 can include a product seal zone 706, an unsealed pouch area 710, a first tab 722, a second tab 724, a first tab-cut 726, and a second tab-cut 728. The package 700 can define a void 720.

In some embodiments, the package 700 can include one or more tactile features 734. In some embodiments, the tactile feature 734 can include one or more slits or cuts through both the first layer 202 and the second layer 204. The slits can increase the user's ability to hold and pull the tab without the user's hand slipping. Such tactile features can be particularly advantageous when the user has fine motor challenges, is partially disabled, wearing gloves or is working in a wet or slippery environment. In some embodiments, the slits can be "V" shaped. In some embodiments, the tactile feature 734 can include more than one slit or cut. In some embodiments, a tactile feature 734 can include at least three slits, such as three V-shaped slits. In some embodiments, each of slits can be identical to each other. In some embodiments, the slits are not defined by removing material from the first layer 202 or the second layer 204. The slits can be defined by separating portions of the layers from themselves, such as by cutting.

FIG. 8 shows a front view of a package 800, according to an embodiment. The package 800 can include a product seal zone 806, an unsealed pouch area 810, a first tab 822, a second tab 824, a first tab-cut 826, and a second tab-cut 828. The package 800 can define a void 820.

In some embodiments, the package 800 can include one or more tactile features 834. In some embodiments, the tactile feature 834 can be an oval aperture. The aperture can extend through both the first layer 202 and the second layer 204. In some embodiments, the aperture is configured for a user to be able to insert all or part of his or her fingertip in the aperture. In some embodiments, the tactile feature 834 can occupy at least 25% of the area of a tab in which the tactile feature 834 is located on, such as the aperture covers or removes 25% of the area of the tab. In some embodiments, the tactile feature 834 can occupy at least 50% of the area of a tab in which the tactile feature is located on.

Figure 9:
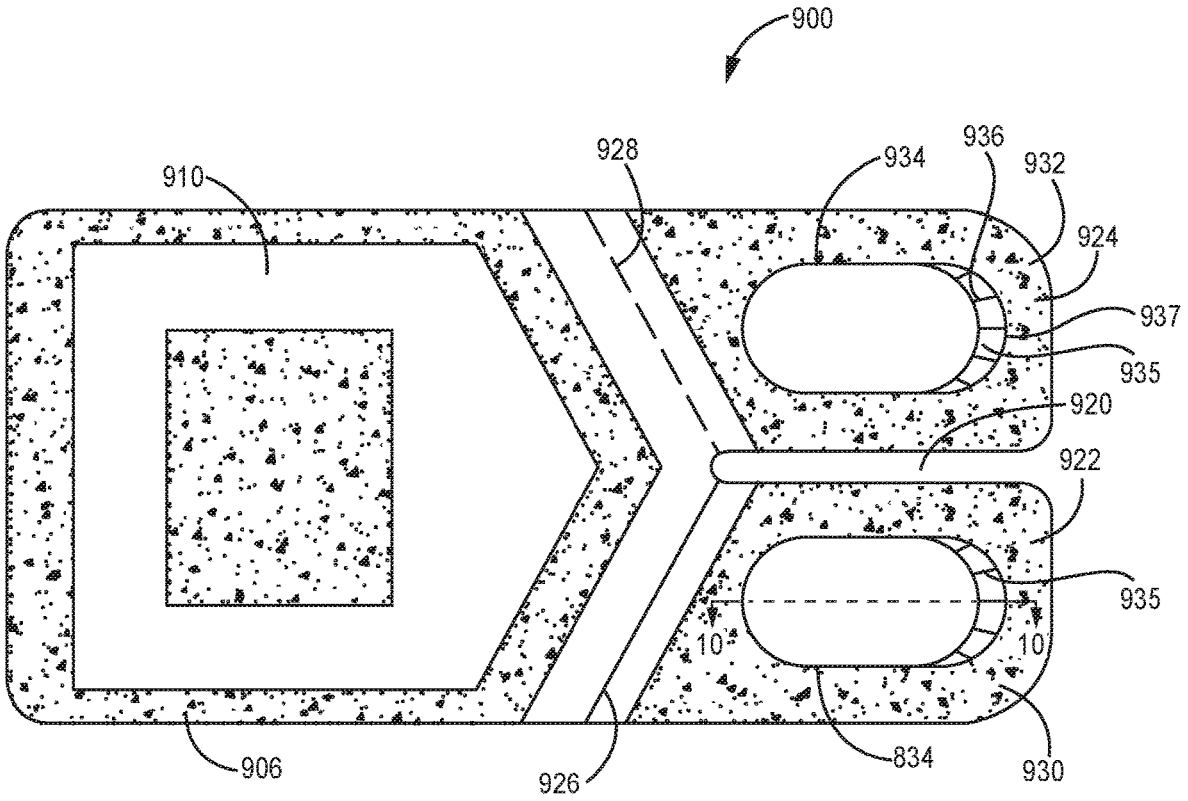
FIG. 9 is a front view of a package with an edge-dulling embodiment of the tactile feature.

FIG. 9 shows a front view of a package 900, according to an embodiment. The package 900 can include a first layer 902 and a second layer 904 (shown in FIG. 10). The package 900 can include product seal zone 906, an unsealed pouch area 910, a first tab 922, a second tab 924, a first tab-cut 926, a second tab-cut 928, a first tab seal zone 930, and a second tab seal zone 932. The package 900 can define a void 920.

In some embodiments, the package 900 can include one or more tactile features 934. In some embodiments, the tactile feature 934 can define an aperture similar to that shown in FIG. 8 and described in respect to FIG. 8, but also including a dulling element 935. The dulling element 935 can dull or round an edge of a tactile feature 934, such as when the tactile feature 934 includes an aperture extending through the first and second layers. The dulling element 935 can be configured to reduce the sharpness of an edge of a tactile feature 934. The dulling element 935 includes two or more fins separated by one or more fin cuts 936. These fins will bend back when the user's finger interacts with the dulling element, so that a folded edge contacts the user's finger instead of a cut edge. The dulling element also includes a crease 937, which facilitates the fins to bend. The dulling element 935 is positioned along a portion of an aperture edge. In some embodiments, the dulling element includes a folded portion of at least one of the first or second layer.

Figure 10:
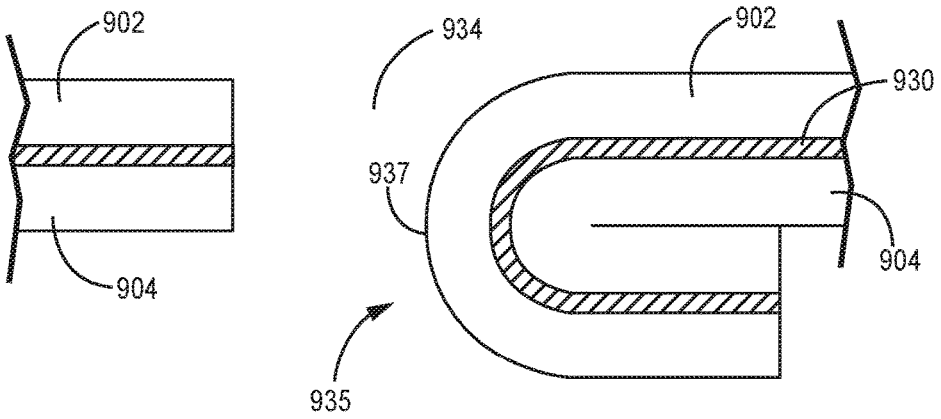
FIG. 10 is a cross-sectional view of a portion of the package in FIG. 9 during the process of opening the package.

FIG. 10 shows a cross-sectional view of the package 900 taken along line 10-10 in FIG. 9. FIG. 10 shows the dulling element 935 in a bent position, folded along the crease line 937, as it would be when the user's finger contacts the dulling element 936. In some embodiments, the dulling element 935 can include folding over a portion of the package 900 that includes the first layer 902 sealed with the second layer 904, such that one of the layers is folded back onto itself (the second layer 904 in FIG. 10) and the other layer (the first layer 902 in FIG. 10) defines an edge or portion of the tactile feature 934 at the crease 937. In some embodiments, the package 900 can include a folded portion as the dulling element 935 when the package 900 is manufactured. In alternative embodiments, a user's finger can cause the fold of a designated portion of the package 900 to create the dulling element 935 prior to opening the package 900.

Figure 11:
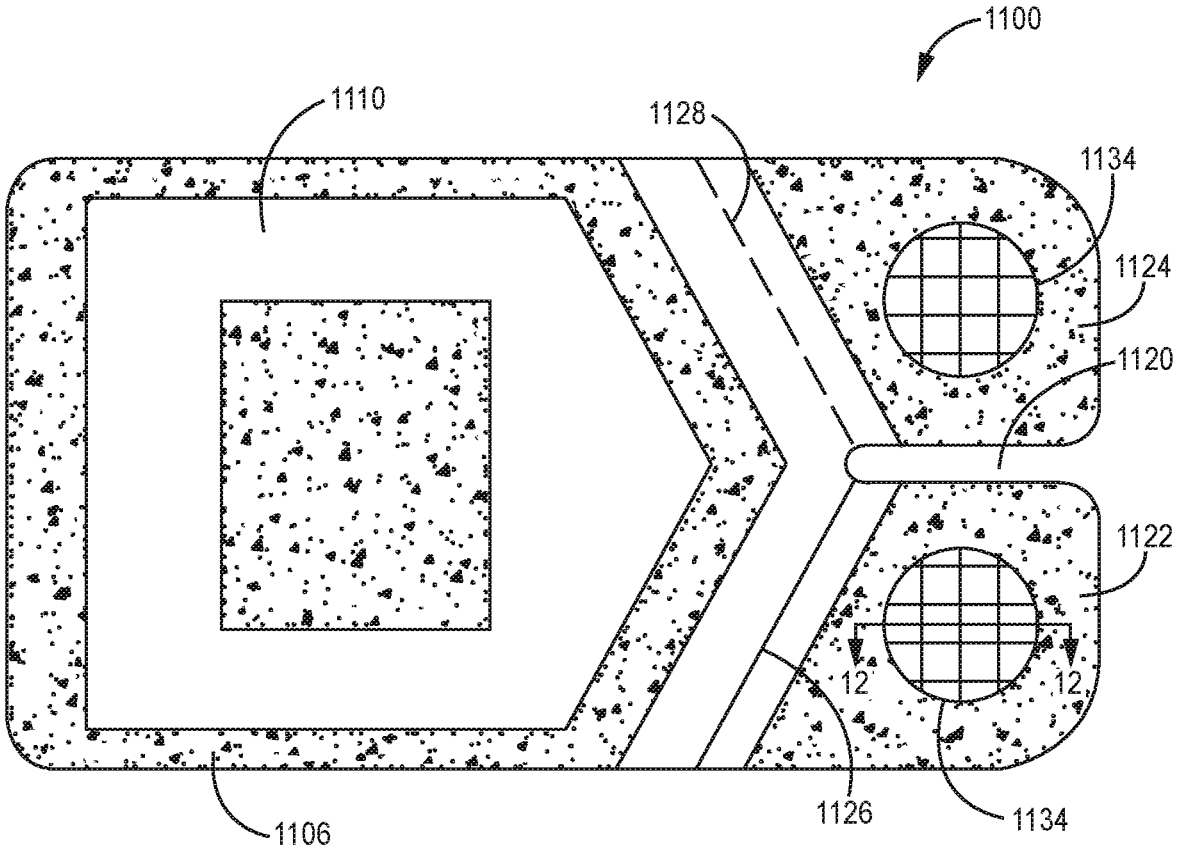
FIG. 11 is a front view of a package with a different embodiment of the tactile feature.

FIG. 11 shows a front view of a package 1100, according to an embodiment. The package 1100 can include product seal zone 1106, an unsealed pouch area 1110, a first tab 1122, a second tab 1124, a first tab-cut 1126, and a second tab-cut 1128. The package 1100 can define a void 1120.

Figure 12:
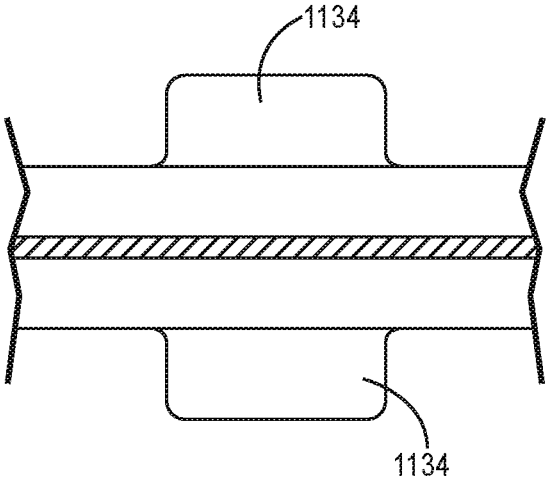
FIG. 12 is a cross-sectional view of a portion of the package in FIG. 11.

In some embodiments, the package 1100 can include one or more tactile features 1134. In some embodiments, the tactile feature 1134 can include a raised projection, such as shown in FIGS. 11 and 12. FIG. 12 shows a cross-sectional view of a portion of the package 1100 in FIG. 11. The raised projection can be gripped by a user when opening the package 1100. In some embodiments, the first tab 1122 includes a single raised projection and the second tab 1124 includes a single raised projection. In some embodiments, the raised projection of the first tab 1122 can be on the same side of the packages as the raised projection of the second tab 1124. In an alternative embodiment, the raised projection of the first tab 1122 can be on an opposite side of the package 1100 from the raised projection of the second tab 1124, such that the projections can extend in opposite directions.

In some embodiments, the first tab 1122 includes two raised projections, such as one on each side of the package. In various embodiments, the second tab 1124 can also include two raised projections on opposite sides of the package 1100, such that each tab 1122, 1124 has one raised projection on each side of the package 1100.

Figure 13:
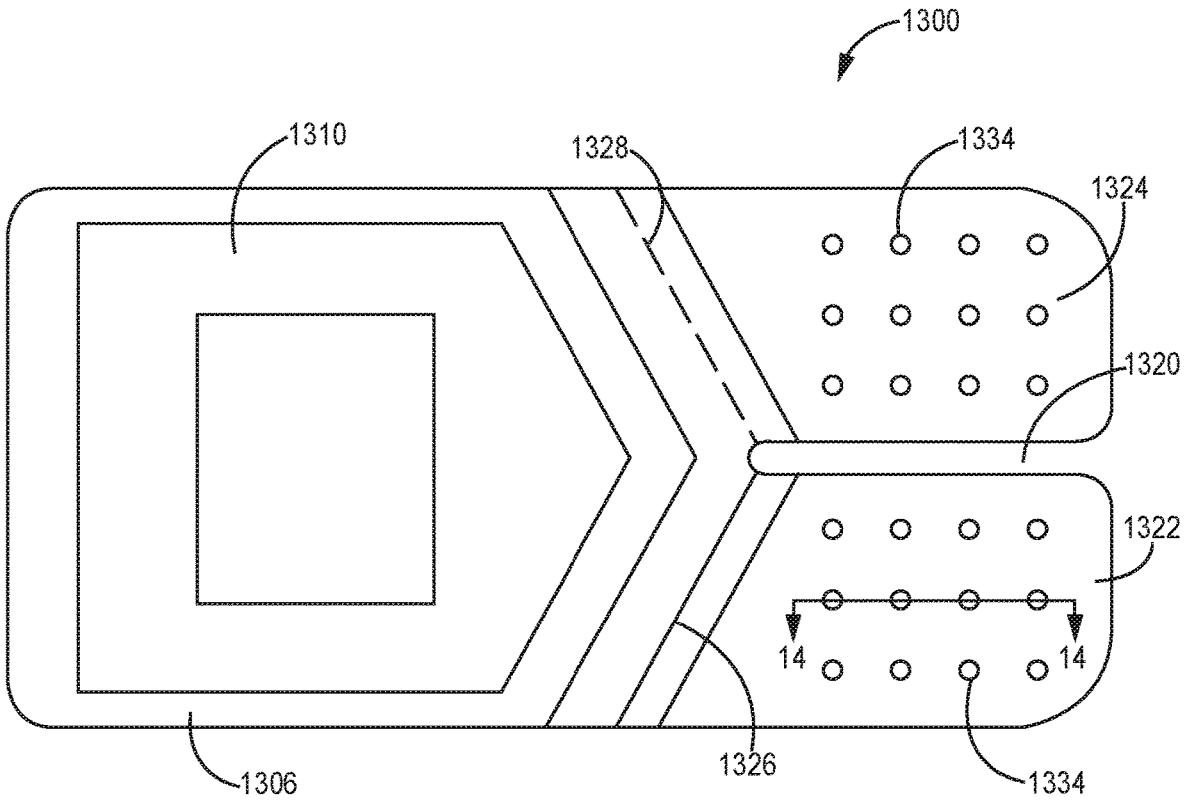
FIG. 13 is a front view of a package with a different embodiment of the tactile feature.

FIG. 13 shows a front view of a package 1300, according to an embodiment. The package 1300 can include product seal zone 1306, an unsealed pouch area 1310, a first tab 1322, a second tab 1324, a first tab-cut 1326, and a second tab-cut 1328. The package 1300 can define a void 1320.

Figure 14:
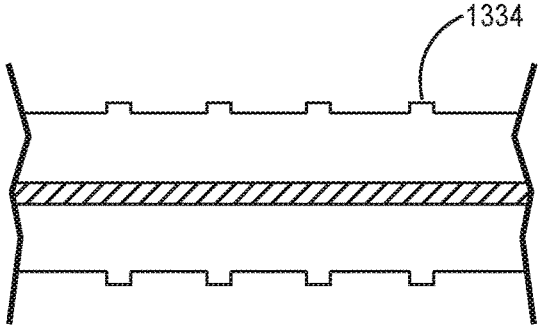
FIG. 14 is a cross-sectional view of a portion of the package in FIG. 13.

In some embodiments, the package 1300 can include one or more tactile features 1334. In some embodiments, the tactile feature 1134 can include a plurality of raised projections, such as shown in FIGS. 13 and 14. In some embodiments, the first tab 1322 can include a plurality of raised projections on one side of the package 1300. In some embodiments, the first tab 1322 can include a plurality of raised projections on both sides of the package 1300 (as shown in FIG. 14). The second tab 1324 can also include a plurality of raised projections on one or on both sides of the package 1300. In some embodiments, the first tab 1322 can include a plurality of raised projections on one side of the package 1300 and the second tab 1324 can include a plurality of raised projections on the other side of the package 1300. In some embodiments, the plurality of raised projections can be arranged in repeating pattern, such as having the projections arranged in rows and columns.

Figure 15:
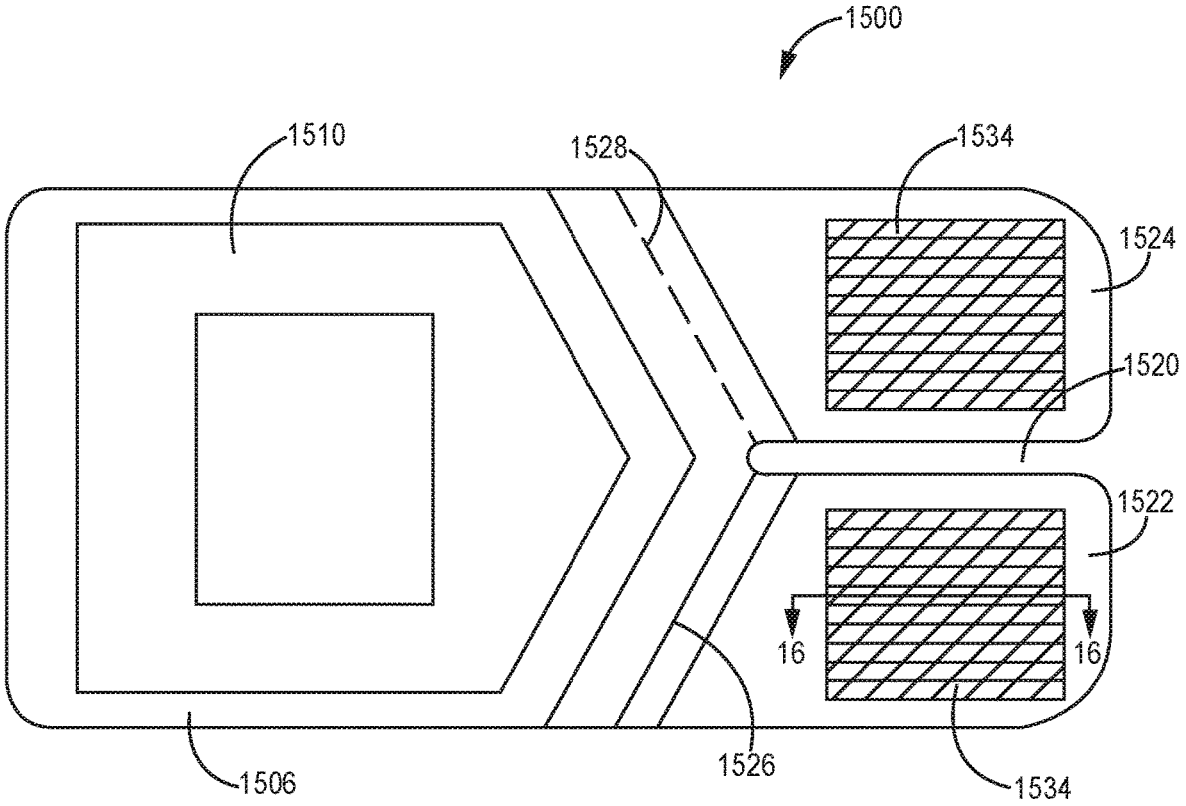
FIG. 15 is a front view of a package with a different embodiment of the tactile feature.

FIG. 15 shows a front view of a package 1500, according to some embodiments. The package 1500 can include product seal zone 1506, an unsealed pouch area 1510, a first tab 1522, a second tab 1524, a first tab-cut 1526, and a second tab-cut 1528. The package 1500 can define a void 1520.

Figure 16:
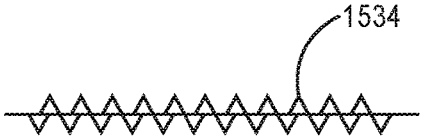
FIG. 16 is a cross-sectional view of a portion of the package in FIG. 15.

In some embodiments, the package 1500 can include one or more tactile features 1534. In some embodiments, the tactile feature 1534 can include a zig zag portion, such as a portion of the package that includes repeating switchback portions. As shown in FIG. 16, the package 1500 can be textured by folding or creasing portions of the first and second layers to define a plurality of switchback portions.

In various embodiments, a package can include one or more scores on the first layer and/or on the second layer. A score can include a perforation, a channel or a weakened portion of the layer that facilitates tearing or separating a portion of the layer from an adjacent portion of the layer, such as to gain access to the product within the unsealed pouch area. In some embodiments, the scores can be laser scores, such that they are burned or melted into the layer. In some embodiments that include scoring the package can be opened by tearing one or both of the layers along the scoring to gain access to the product, such as without separating the layers along the seal zone. In some embodiments that include scoring the first and/or second layers, the product seal zone can include a non-peelable seal, such that attempting to separate the two layers along a portion of the seal that is non-peelable seal would result in tearing or destroying portions of the layer adjacent to the seal.

Figure 17:
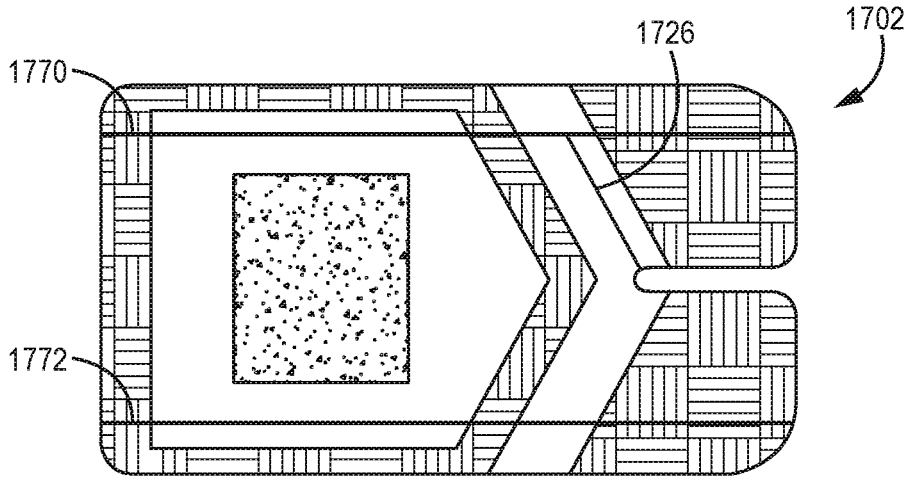
FIG. 17 is a front view of a first layer with an embodiment of scoring the layer.
Figure 18:
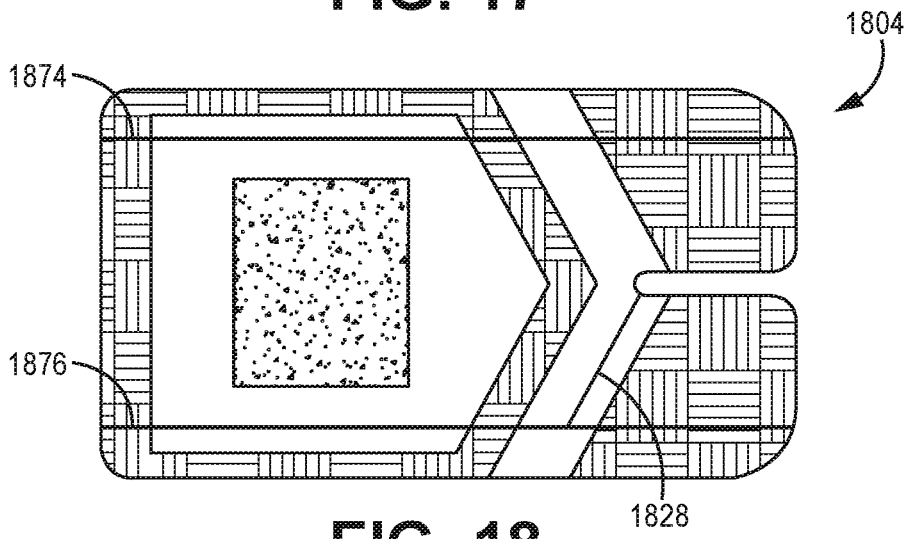
FIG. 18 is a front view of a second layer with an embodiment of scoring the layer.
Figure 19:
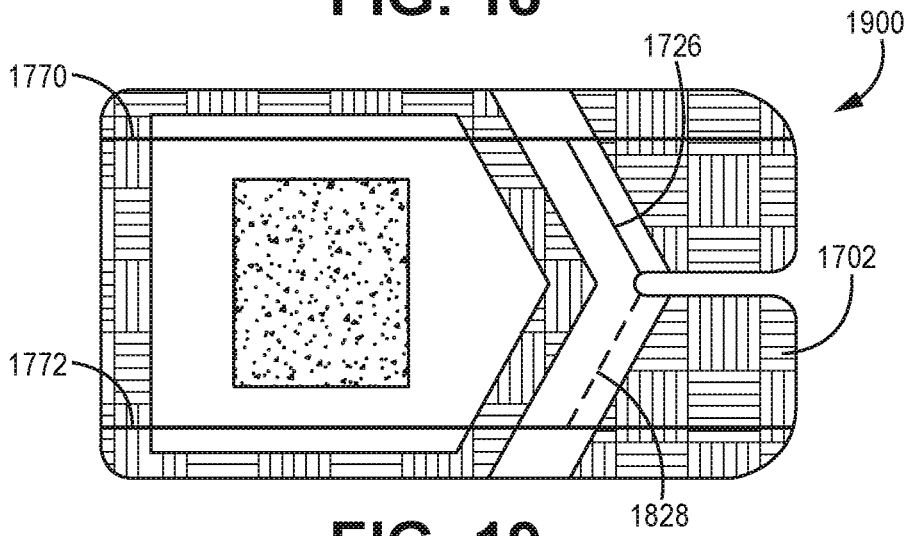
FIG. 19 is a front view of a package with an embodiment of scoring.

FIGS. 17-19 show an embodiment of a package 1900. FIG. 17 shows a front view of the first layer 1702 for the package 1900. FIG. 18 shows a front view of the second layer 1804 for the package 1900. FIG. 19 shows a front view of the package 1900 that includes the first layer 1702 and the second layer 1804.

In some embodiments, the first layer 1702 can include a first score 1770 that extends along one side edge of the package, along a side edge of the unsealed pouch area. The first layer 1702 can further include a second score 1772 that extends along one side edge of the package, and along a side edge of the unsealed pouch area. The first layer 1702 can further include a tab-cut 1726. In some embodiments, the first score and second score extend from one end of the package to the opposite end of the package, as shown in FIGS. 17-19. In some embodiments, the tab-cut 1726 can extend from the void to one of the scores 1770, 1772.

Like the first layer 1702, the second layer 1804 can include a first score 1874 and, in some embodiments, a second score 1876. In various embodiments, the first score 1874 and the second score 1876 can be parallel. In various embodiments, the first score 1874 and the second score 1876 can extend from one end of the package to the opposite end of the package. The second layer 1804 can also include a tab-cut 1828. The tab-cut 1828 can extend from the void to one of the score 1874, 1876.

FIG. 19 shows a package 1900 from a front view with the first layer 1702 on top. The package 1900 has a first score 1770 and a second score 1772 in the first layer 1702. The package 1900 can further include a first score 1874 and a second score 1876 in the second layer. The package 1900 can include two tab-cuts 1726 and 1828. The package 1900 can be opened by the user pulling the tabs in opposite directions and tearing the first layer 1702 and/or second layer 1804 along one or both of the scores in the layer.

Figure 20:
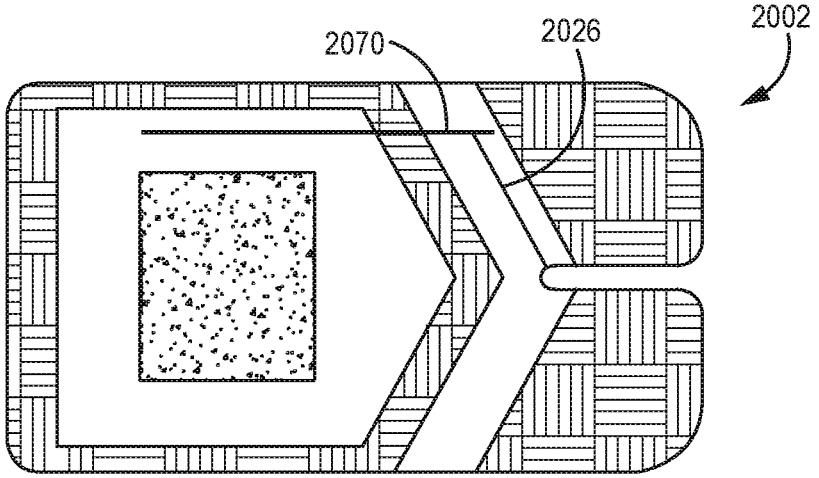
FIG. 20 is a front view of a first layer with an embodiment of scoring the layer.
Figure 21:
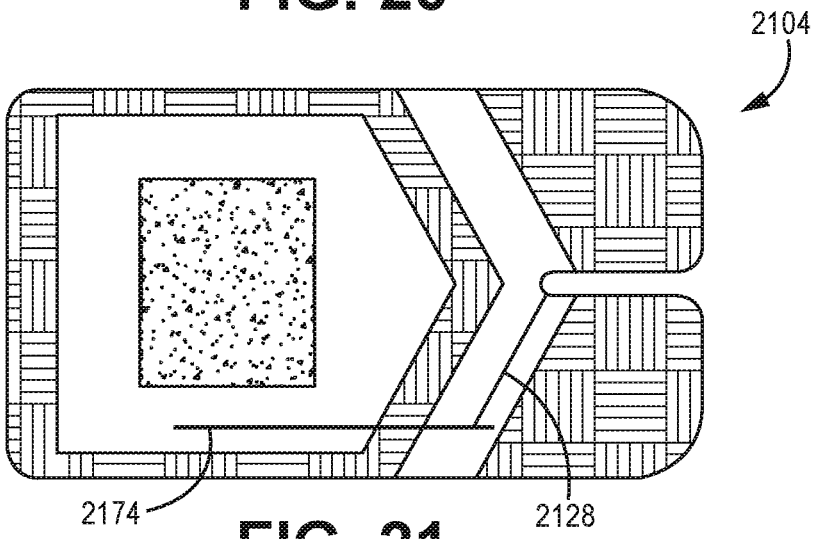
FIG. 21 is a front view of a second layer with an embodiment of scoring the layer.
Figure 22:
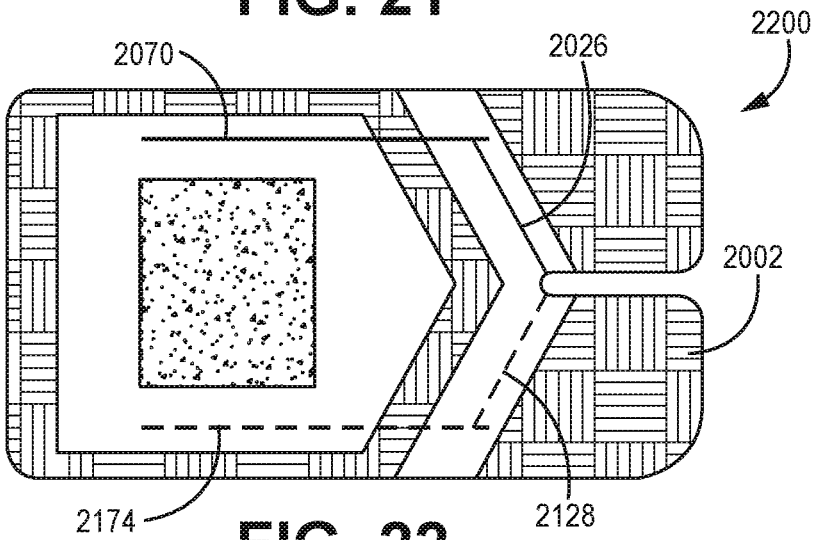
FIG. 22 is a front view of a package with an embodiment of scoring.

FIGS. 20-22 show an embodiment of a package 2200. FIG. 20 shows a front view of the first layer 2002 for the package 2200. FIG. 21 shows a front view of the second layer 2104 for the package 2200. FIG. 22 shows a front view of the package 2200 that includes the first layer 2002 and the second layer 2104.

In some embodiments, the first layer 2002 can include a first score 2070 that extends within the layer 2002, such that it does not intersect the edge or perimeter of the layer 2002. In some embodiments, the first score 2070 can extend into the unsealed pouch area. In some embodiments, the first score 2070 can extend from an unsealed area between the tab seal zones and the product seal zone to the unsealed pouch area. The first layer 2002 can further include a tab-cut 2026. In some embodiments, the tab-cut 2026 can extend from the void to the scores 2070.

Like the first layer 2002, the second layer 2104 can include a score 2174. The score 2174, similar to score 2070 can terminate within the unsealed pouch area, such as at a point after the product is exposed during opening and able to be removed from the package. The second layer 2104 can also include a tab-cut 2128. The tab-cut 2128 can extend from the void to the score 2174.

FIG. 22 shows a package 2200 with a score 2070 in the first layer 2002 and a score 2174 in the second layer 2104. The package 2200 can include two tab-cuts 2026 and 2128. The package 2200 can be opened by the user pulling the tabs in opposite directions and tearing the first layer 2002 and/or second layer 2104 along the score in the respective layer.

Figure 23:
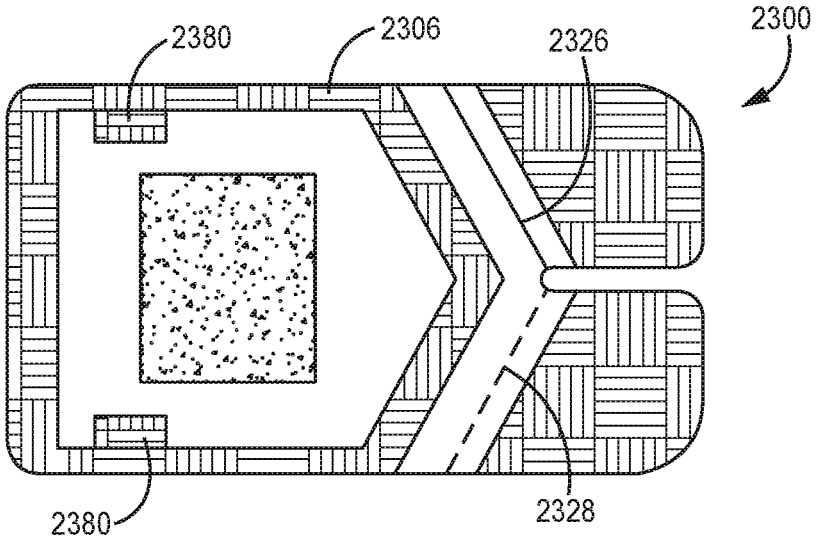
FIG. 23 is a front view of a package with a different embodiment of the product seal zone.

FIG. 23 shows a front view of a package 2300 with a different embodiment of the product seal zone 2306. The product seal zone 2306 can include a bump out portion 2380, such as a portion of the seal zone that includes more area of the first layer being joined to the second layer. The bump out portion 2380 can require a user to apply additional force to open the package 2300 compared to the adjacent portions of the seal zone 2306. The bump out portion 2380 can be located such that when a user is opening the package the product is able to be removed from the package without separating the layers at the bump out portion 2380. The bump out portion 2380 can require additional force such that a user is made aware that the product can be removed from the package 2300 without further opening the package 2300 and increasing the risk that the product can fall out of the package 2300.

In some embodiments, an increase in force can be required to separate the layers along the product seal zone at a first location when compared to adjacent portions of the product seal zone. In some embodiments, the seal can be tight, such that it requires more force to separate the layers, along a portion of the seal that is on the opposite side of the product from the header. In some embodiments, the tighter seal can be established by more pressure being applied when sealing the layers together.

Figure 24:
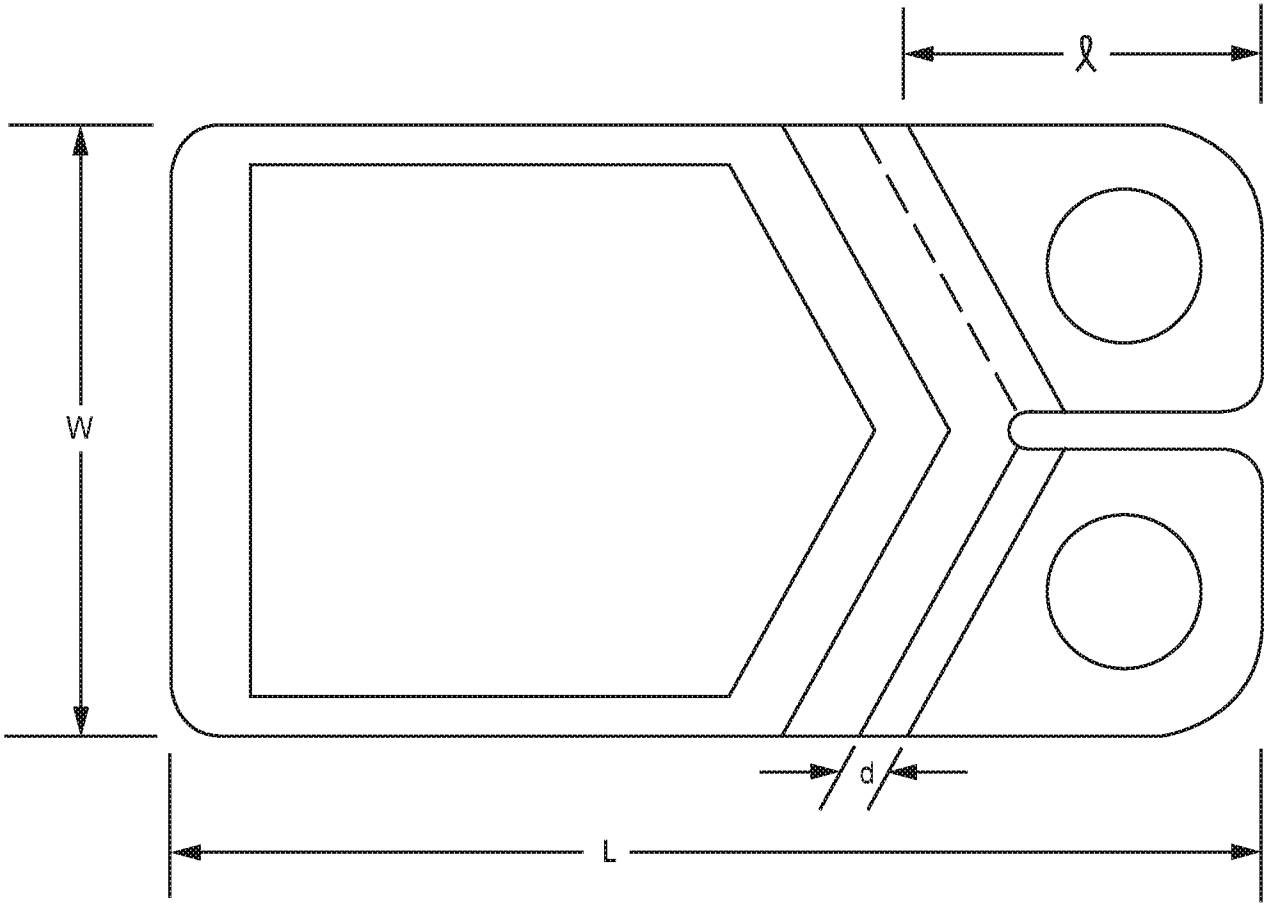
FIG. 24 is a front view of a package, according to an embodiment.

FIG. 24 is a front view of a package, according to an embodiment. In some embodiments, the package 100 can have a length (L) of at least 1.5 inches and not more than 9 inches. In some embodiments, the package 100 can have a length (L) of at least 1.5 inches and not more than 6 inches. In some embodiments, the package 100 can have a length (L) of at least 2 inches and not more than 6 inches. In some embodiments, the package 100 can have a length (L) of at least 2.5 inches and not more than 5.5 inches. In some embodiments, the package 100 can have a length (L) of at least 3 inches and not more than 4.5 inches. In some embodiments, the package 100 can have a length (L) of about 3.5 inches. In some embodiments, the package 100 can have a length (L) of about 4 inches. In some embodiments, the package 100 can have a length (L) of about 8 inches.

In some embodiments, the package 100 can have a length (L) of at least 1.5 inches. In some embodiments, the package 100 can have a length (L) of at least 2 inches. In some embodiments, the package 100 can have a length (L) of at least 2.5 inches. In some embodiments, the package 100 can have a length (L) of at least 3 inches.

In some embodiments, the package 100 can have a length (L) of no more than 4.5 inches. In some embodiments, the package 100 can have a length (L) of no more than 5.5 inches. In some embodiments, the package 100 can have a length (L) of no more than 6 inches. In some embodiments, the package 100 can have a length (L) of no more than 9 inches.

In some embodiments, the package 100 can have a width (W) of at least 1 inch and not more than 5 inches. In some embodiments, the package 100 can have a width (W) of at least 1 inch and not more than 4 inches. In some embodiments, the package 100 can have a width (W) of at least 1 inch and not more than 3 inches. In some embodiments, the package 100 can have a width (W) of at least 1.5 inches and not more than 2.5 inches. In some embodiments, the package 100 can have a width (W) of about 2 inches, such as 1.95 inches. In some embodiments, the package 100 can have a width (W) of about 4 inches, such as 3.9 inches.

In some embodiments, the package 100 can have a width (W) of at least 1 inch. In some embodiments, the package 100 can have a width (W) of at least 1.5 inches. In some embodiments, the package 100 can have a width (W) of at least 1.75 inches.

In some embodiments, the package 100 can have a width (W) of no more than 5 inches. In some embodiments, the package 100 can have a width (W) of no more than 4 inches. In some embodiments, the package 100 can have a width (W) of no more than 3 inches. In some embodiments, the package 100 can have a width (W) of no more than 2.5 inches.

In some embodiments, the void 120 can extend at least 10% of the length of the package 100. In some embodiments, the void 120 can extend at least 15% of the length of the package 100. In some embodiments, the void 120 can extend at least 20% of the length of the package 100. In some embodiments, the void 120 can extend at least 25% of the length of the package 100.

In some embodiments, the first tab seal zone 130 and the second tab seal zone 132 can have the same length (l). In some embodiments, the first tab seal zone 130 or the second tab seal zone 132 can have a length (l) from the end of the package 100 to the furthest portion of the first tab seal zone 130 or the furthest portion of the second tab seal zone 132. In some embodiments, the first tab seal zone 130 or the second tab seal zone 132 can have a length (l) of at least 1 inch not more than 3.5 inches. In some embodiments, the first tab seal zone 130 or the second tab seal zone 132 can have a length (l) of at least 1 inch not more than 2 inches. In some embodiments, the first tab seal zone 130 or the second tab seal zone 132 can have a length (l) of at least 1.5 inches not more than 1.75 inches. In some embodiments, the first tab seal zone 130 or the second tab seal zone 132 can have a length (l) of about 1.65 inches. In some embodiments, the first tab seal zone 130 or the second tab seal zone 132 can have a length (l) of at least 0.5 inches and not more than 3 inches. In some embodiments, the first tab seal zone 130 or the second tab seal zone 132 can have a length (l) of at least 0.75 inches and not more than 1.5 inches. In some embodiments, the first tab seal zone 130 or the second tab seal zone 132 can have a length (l) of at least 1 inch and not more than 1.25 inches. In some embodiments, the first tab seal zone 130 or the second tab seal zone 132 can have a length (l) of about 1.15 inches. In some embodiments, the first tab seal zone 130 or the second tab seal zone 132 can have a length (l) of about 3.3 inches.

In some embodiments, the first tab seal zone 130 or the second tab seal zone 132 can have a length (l) of at least 0.5 inches. In some embodiments, the first tab seal zone 130 or the second tab seal zone 132 can have a length (l) of at least 0.75 inches. In some embodiments, the first tab seal zone 130 or the second tab seal zone 132 can have a length (l) of at least 1 inch. In some embodiments, the first tab seal zone 130 or the second tab seal zone 132 can have a length (l) of at least 1.5 inches.

In some embodiments, the first tab seal zone 130 or the second tab seal zone 132 can have a length (l) of no more than 1.25 inches. In some embodiments, the first tab seal zone 130 or the second tab seal zone 132 can have a length (l) of no more than 1.5 inches. In some embodiments, the first tab seal zone 130 or the second tab seal zone 132 can have a length (l) of no more than 1.75 inches. In some embodiments, the first tab seal zone 130 or the second tab seal zone 132 can have a length (l) of no more than 2 inches. In some embodiments, the first tab seal zone 130 or the second tab seal zone 132 can have a length (l) of no more than 3 inches. In some embodiments, the first tab seal zone 130 or the second tab seal zone 132 can have a length (l) of no more than 3.5 inches.

In some embodiments, the space (d) between the first tab-cut 126 and the first tab seal zone 130 or the space (d) between the second tab-cut 128 and the second tab seal zone 132 can be at least 0.05 inches and not more than 0.5 inches. In some embodiments, the space (d) between the first tab-cut 126 and the first tab seal zone 130 or the space (d) between the second tab-cut 128 and the second tab seal zone 132 can be at least 0.1 inches and not more than 0.25 inches. In some embodiments, the space (d) between the first tab-cut 126 and the first tab seal zone 130 or the space (d) between the second tab-cut 128 and the second tab seal zone 132 can be about 0.28 inches, 0.15 inches, or 0.14 inches.

In some embodiments, the space (d) between the first tab-cut 126 and the first tab seal zone 130 or the space (d) between the second tab-cut 128 and the second tab seal zone 132 can be at least 0.05 inches. In some embodiments, the space (d) between the first tab-cut 126 and the first tab seal zone 130 or the space (d) between the second tab-cut 128 and the second tab seal zone 132 can be at least 0.1 inches.

In some embodiments, the space (d) between the first tab-cut 126 and the first tab seal zone 130 or the space (d) between the second tab-cut 128 and the second tab seal zone 132 can be no more than 0.5 inches. In some embodiments, the space (d) between the first tab-cut 126 and the first tab seal zone 130 or the space (d) between the second tab-cut 128 and the second tab seal zone 132 can be no more than 0.25 inches.

The first layer 202 and the second layer 204 can include a variety of materials and combinations of materials that are generally known in the art, such as a polyester film, spunbonded olefin, DuPont TYVEK® brand spunbonded olefin, linear low density polyethylene with polybutylene, biaxially oriented polyester film, polypropylene film, high density polyethylene film, acrylonitrile co-polymer film, BAREX® brand acrylonitrile co-polymer film available from BP Chemicals, Inc., cast polyethylene terephthalate (PET) or polyethylene terephthalate glycol (PETG) film, metal foil, aluminum foil, poly-vinylidene dichloride (PVDC) film, co-extruded films containing ethylene vinyl alcohol polymer (EVOH), polyvinyl alcohol (PVA) film, polyamide film, vinyl film, high density polyethylene (HDPE), ACLAR® brand film, cold or thermo forming films, multilayer heat sealable pouch films, or composite laminations or coatings that contain the same. In a variety of embodiments, the first layer 202 and the second layer 204 are heat sealable or sealable using ultrasonic welding, pressure or vibration. In some embodiments, only one of the first layer 202 and second layer 204 is heat sealable, and the other is a compatible material to create a peelable seal. In one embodiment, each of the first and second layers 202, 204 includes a polyester layer, such as a DuPont TYVEK® brand spunbonded olefin, a tie layer and a sealant layer. In one embodiment, the polyester film, tie layer and sealant layer are coextruded or laminated to form a single film. One example of an appropriate sealant layer is linear low density polyethylene with polybutylene, which is activated by heat to bond to the other layer. In some embodiments, the layers 202, 204 are joined by methods other than heat sealing. For example, the layers 202, 204 may be joined by ultrasonic welding in some embodiments. In some embodiments, the layers 202, 204 may be joined by more than one method, such as both heat sealing and ultrasonic welding.

In a variety of embodiments, the first layer 202 and the second layer 204 are substantially non-permeable. In a variety of embodiments, the first layer 202 and the second layer 204 are substantially permeable. For example, a layer that includes a metal foil layer will be substantially non-permeable, while a layer that includes a DuPont TYVEK® brand spunbonded olefin will be permeable. In a variety of embodiments, the first layer 202 and the second layer 204 are substantially flexible, although in some embodiments one of the first layer 202 or the second layer 204 or both are substantially rigid. In some embodiments, one or both of the layers is transparent so that the product 112 is visible through the transparent layer. Alternative terms that can be used to describe the first layer 202 and the second layer 204 include film, sheet, web, and the like.

The first layer 202 is generally coextensive with the second layer 204 and, as mentioned above, the first layer 202 and second layer 204 are at least partially joined with a peelable seal. Generally, the peelable seal is a hermetic bond between the contacting surfaces of the first layer 202 and second layer 204. The peelable seal can be formed by any appropriate method known in the art. In a variety of embodiments, peelable seal is a heat seal or melt bonded relationship caused by the application of heat and pressure. In an alternate embodiment, peelable seal is formed with a suitable adhesive applied to at least one of the contacting surfaces of the first layer 202 and second layer 204. In at least one embodiment, the peelable seal is re-sealable, thereby allowing a user to reclose the package 100.

In general the peelable seal is configured to have strength conducive to allowing a user to peel the first layer 202 and the second layer 204 apart without the use of tools, to access the product 112 there between. In one embodiment, the peelable seal strength is in the range of 1.25 to 2 pounds per linear inch of seal when pulled apart at 180 degrees at 12 inches per minute travel rate according to testing procedure TAPPI T-494 as published by the Technical Association of the Pulp and Paper Industry. In some embodiments the peelable seal strength is in the range of 1.0 to 2.5 pounds per linear inch of seal. In a variety of embodiments the peelable seal has strength in the range of 0.25 to 3.5 pounds per linear inch of seal.

Figure 25:
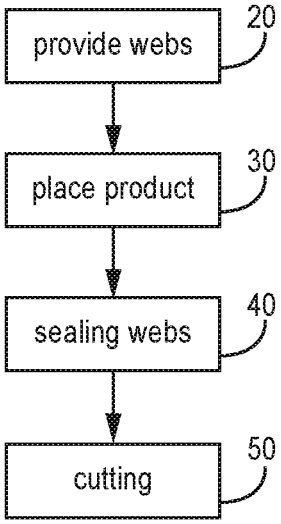
FIG. 25 is a flow chart depicting a method of making a package, according to an embodiment.
Figure 26:
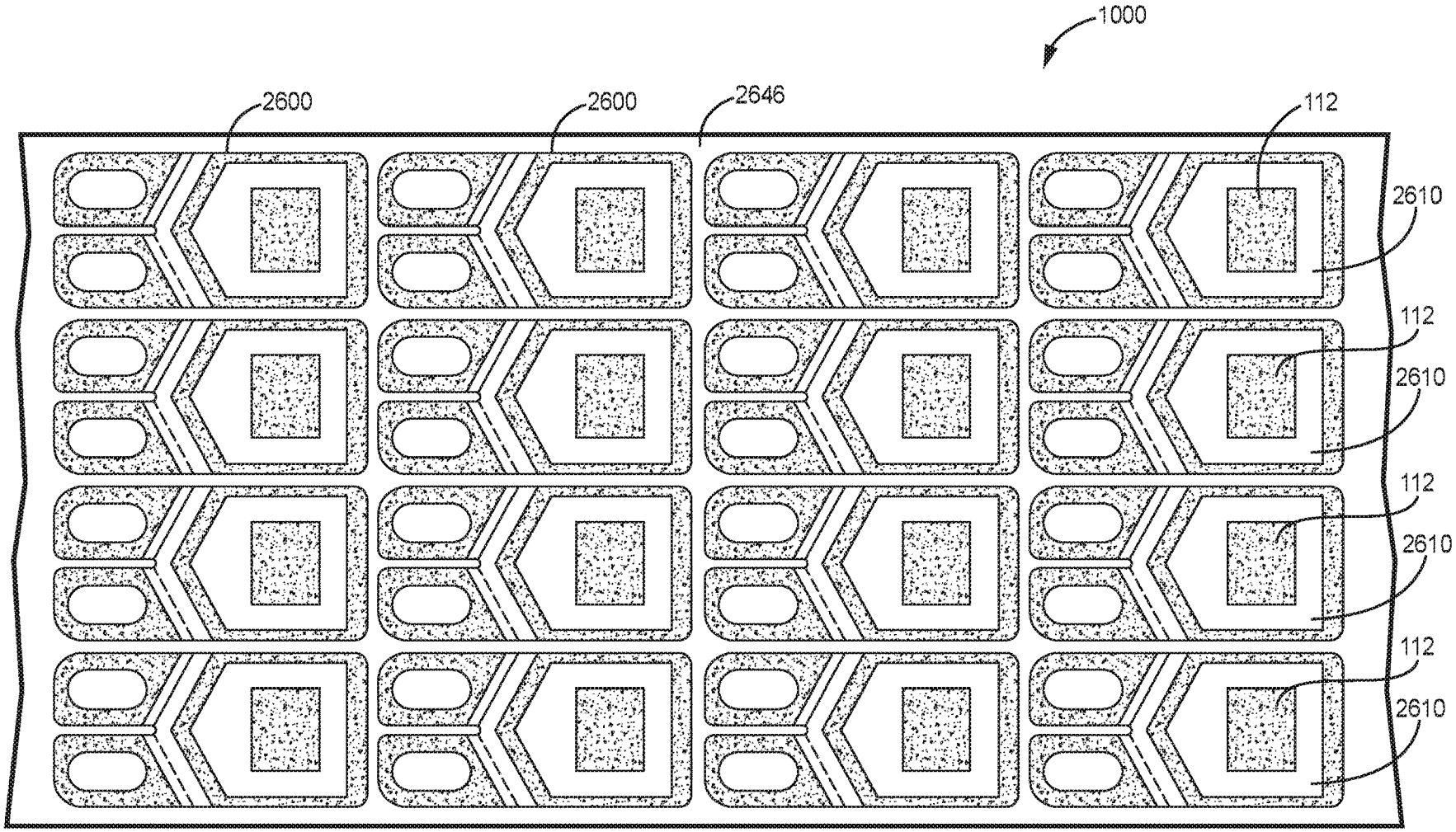
FIG. 26 is a front view of a web of packages during an assembly process, according to an embodiment.

FIG. 25 depicts a flow chart consistent with one method of manufacturing a package consistent with the technology disclosed herein. Generally, at least two webs are provided 20, product is placed 30 on one web, the webs are sealed 40 to enclose the product within an unsealed area, and then the web is cut 50 into packages, the void is defined by a cut and the tab-cuts are made. FIG. 26 depicts an example combined web 1000 consistent with the method associated with FIG. 25 prior to cutting 50. The packages formed from these components can be for containing and dispensing a product.

The step of providing webs 20 generally encompasses providing a first layer web and a second layer web, although additional webs can be provided also. The first layer web and second layer web can be a variety of different materials, as described herein. Placing a product 30 generally encompasses placing a product on at least one pouch area of the second layer web.

FIG. 26 shows a combined web 1000 which includes a first layer web and a second layer web. The combined web 1000 includes individual packages 2600, each having a pouch area 2610 and a product 112 in the pouch area 2610. The individual packages 2600 are separated from each other by a web matrix 2646.

Now referring to FIG. 26 and the steps of FIG. 25, in a variety of embodiments multiple products 112 are placed on the second layer web in corresponding pouch areas 2610 of the second layer web. The webs are sealed at step 40 to form a combined web 1000 by sealing the first layer web to the second layer web at least at one of the seal zones, so that the first layer is joined to the second layer by a peelable seal. In some embodiments, the first layer web can be sealed with the second layer web at the product seal zone, the first tab seal zone, and the second tab seal zone. In multiple embodiments, including the embodiment depicted in FIG. 26, forming a combined web also includes sealing the first layer web to the second layer web at a first tab seal zone which is within a first tab and a second tab seal zone which is within a second tab.

The webs are generally sized to create multiple packages, and may be very long, also referred to as continuous, in the machine direction and have a cross-machine direction of one to five packages, or more. Combined web 1000 of FIG. 26 has a width of two packages, and is very long in the machine direction. The phrase "very long in the machine direction" is used to mean a web that is typically substantially longer than it is wide, such as one-hundred or one-thousand times longer than its width, and is often processed on rolls.

In at least one example implementation of the method of FIG. 25, sealing the webs 40 is accomplished in line in a continuous motion machine. A seal plate can be used for joining a first layer web and a second layer web with a heat seal or other seal at a seal zone to form the combined web 1000. In such an implementation, the seal plate itself defines a product seal zone having an inner perimeter and an outer perimeter, as well. In the web embodiment depicted in FIG. 26, such a seal plate also defines a first tab seal zone and a second seal zone within individual package tab areas.

The combined web is then cut 50 to produce at least one individual package. The package is cut along center machine-direction cut lines, cross-machine direction cut lines and outer machine direction cut lines to separate the individual package 2600 from a matrix 2646. A web matrix 2646 allows for some tolerance in the sealing and cutting steps.

In a variety of embodiments, the step of cutting 50 also includes cutting only the first layer of the package at a first tab-cut location to define a first tab in the package 2600 and cutting only the second layer of the package at a second tab-cut location to define a second tab in the package. As described above, the tab-cuts are generally outside of the product seal zone, the first tab seal zone, and the second tab seal zone, and are within the unsealed header area. In a variety of embodiments, each individual package is die cut around its respective outer perimeter and at the tab-cut locations. In addition to cutting the tab-cuts in each package, the void can be cut into each package. In a variety of embodiments, each individual package is die cut around its respective outer perimeter and at the tab-cut locations in a single die cutting station and step. In at least one example implementation, the die cutting 50 is accomplished in a rotary die cutting station. In such an example, the rotary die can cut against an anvil roll, for example. In other embodiments, the packages are knife cut or guillotine cut at their outer perimeters.

Figure 27:
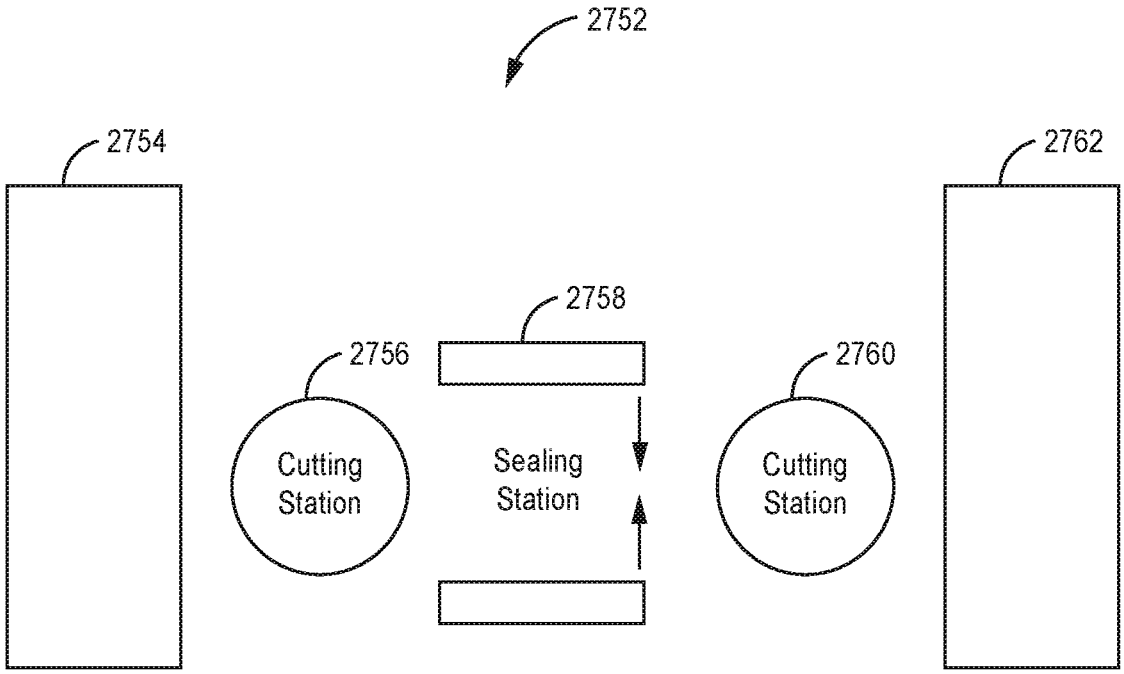
FIG. 27 is a schematic drawing of package-making equipment, according to an embodiment.

FIG. 27 is a schematic drawing of one embodiment of a package-making equipment system 2752 that can be used to make packages as described herein. The system 2752 includes equipment 2754 for providing the input materials for the package, such as the first layer, second layer and product to be packaged. In one embodiment these materials are provided on rolls. A preliminary die station 2756 may be provided in some embodiments before the sealing station 2758 in order to perform any preparatory cuts that are desired. The preliminary die station 2756 can include one or more rotary dies, one or more flat dies, or a combination thereof. In some embodiments, there is no die station 2756 before the sealing station 2758, such as where no preparatory cuts are needed.

The sealing station 2758 performs the step of sealing the webs to join them together at the seal zones. In one embodiment, the sealing station includes multiple heat seal plates that are used to form different seal zones. In one embodiment, a first seal plate is used to form a product seal zone, while a second seal plate is used to form a first tab seal zone and a second tab seal zone. In various embodiments, the sealing station 2758 can use pressure or ultrasonic methods to form different seal zones. In various embodiments, adhesive can be applied to form different seal zones.

A die station 2760 is provided where each package is cut along its exterior perimeter, as discussed in relation to FIG. 26, to separate the individual package from a matrix, and in some embodiments, to define the void between the two tabs. The preliminary die station 2760 can include one or more rotary dies, one or more flat dies, or a combination thereof. The package is also cut in one layer at the first tab-cut location to form the first tab and cut in the other layer at a second tab-cut location to form the second tab. Output equipment 2762 is also provided for processing the individual packages made in the process. The schematic of FIG. 27 shows basic equipment components, but it will be recognized by one of skill in the art that additional equipment could be provide other processing functionality.

Figure 28:
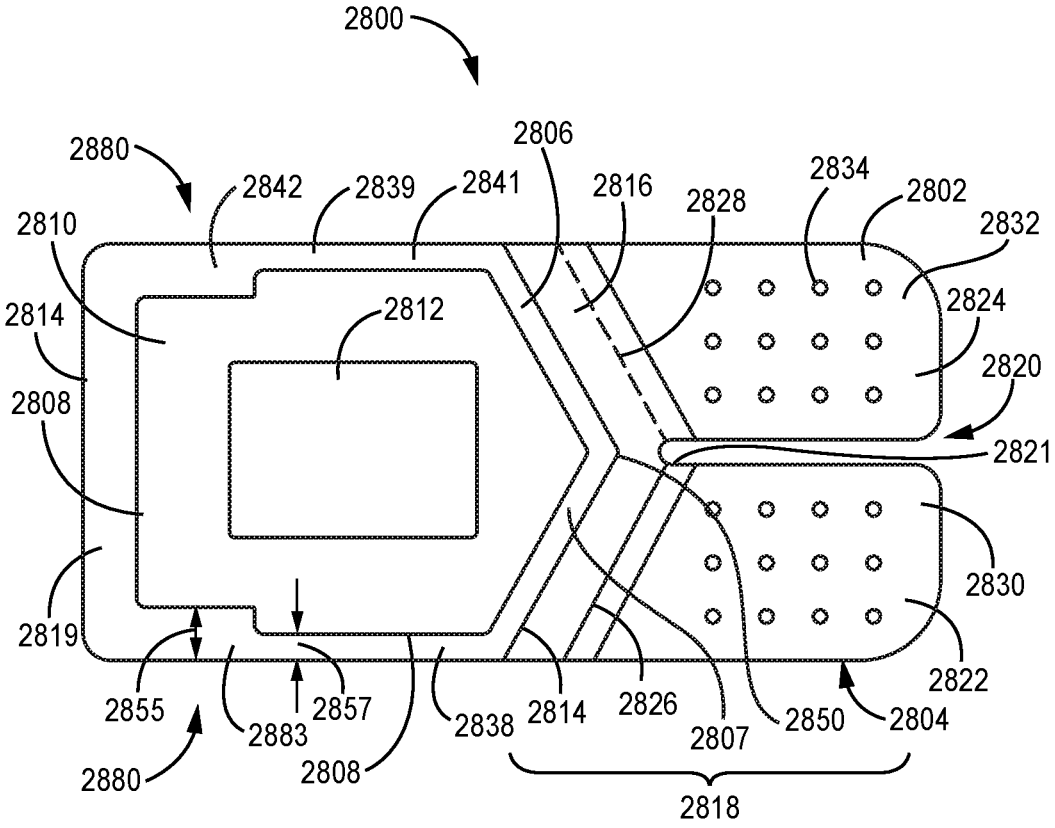
FIG. 28 is a front view of a package incorporating a peel brake feature, according to some embodiments.

FIG. 28 is a front view of a package incorporating a peel brake feature, according to some embodiments. FIG. 28 shows a package 2800 for containing and dispensing a product 2812. In some embodiments, the package 2800 includes tactile features 2834 similar to the tactile features described herein. The package 2800 is constructed from a first layer 2802, a second layer 2804 (on the back side of the first layer 2802 in FIG. 28), and a product seal zone 2806 where the first layer 2802 is joined to the second layer 2804 by a seal 2807. The first layer 2802 and the second layer 2804 are joined together in a manner as described above.

In particular, the first layer 2802 can be joined with the second layer 2804 in one or more seal zones. In the embodiment of FIG. 28, the first layer 2802 and the second layer 2804 are sealed in a first tab seal zone 2830, a second tab seal zone 2832, and the product seal zone 2806. The first layer 2802 and the second layer 2804 are unsealed in an unsealed portion 2816. The first layer 2802 and the second layer 2804 are also unsealed in the unsealed pouch area 2810.

The package 2800 has a header zone 2818 at one end of the package 2800, and a closed end 2819 opposite the header zone 2818. The header zone 2818 is adjacent to the outer perimeter 2814 of the product seal zone 2806. The header zone 2818 includes a first tab 2822 and a second tab 2824. The header zone 2818 also includes the unsealed portion 2816. The first tab seal zone 2830 defines the first tab 2822. The second tab seal zone 2832 defines the second tab 2824. Between the first tab 2822 and the second tab 2824, there is a void 2820. The void 2820 is bounded by an edge 2821 separating the first tab 2822 from the second tab 2824. In some examples, the first tab-cut 2826 does not intersect the second tab-cut 2828. In these examples, the first tab-cut 2826 terminates at the edge 2821 of the package 2800 that defines a portion of the void 2820, and the second tab-cut 2828 also terminates at the edge 2821 of the package 2800.

The product seal zone 2806 has an inner perimeter 2808 and an outer perimeter 2814 that define the bounds of the product seal zone 2806. The inner perimeter 2808 of the product seal zone 2806 defines an unsealed pouch area 2810 for containing the product 2812. The seal 2807 includes a first seal edge 2838 and a second seal edge 2839. The closed end 2819 marks the end of the product seal zone 2806. The seal 2807 shields the product 2812 from exposure.

The header zone 2818 also includes a first tab-cut 2826 in the first layer 2802 within the unsealed portion 2816 of the header zone 2818, and a second tab-cut 2828 in the second layer 2804 within the unsealed portion 2816 of the header zone 2818. The second tab-cut 2828 of FIG. 28 is denoted as a dashed line. The first tab-cut 2826 and the second tab-cut 2828 enable a user to peel apart the first layer 2802 and the second layer 2804 to expose the product 2812.

A user opens the package 2800 to expose the product 2812 by grasping the first tab 2822 in one hand and the second tab 2824 in the other hand, and pulling the two tabs in opposite directions. At first, the seal 2807 resists separation. When the user applies a sufficient force against the resistance of the seal 2807, the force causes the seal 2807 to be broken first at an apex 2850 of the product seal zone 2806. The first layer 2802 then begins peeling apart from the second layer 2804. As the first tab 2822 and the second tab 2824 are pulled farther and farther apart, more of the seal 2807 is broken. Eventually, the first seal edge 2838 and the second seal edge 2839 will be broken as the first layer 2802 and the second layer 2804 are peeled apart.

In some examples, it is desirable to slow down the speed at which the layers can be separated once the package 2800 is open far enough to allow a user to grasp the product 2812 and remove it from the package. In some examples, it is desirable to reduce the likelihood that the first and second layers will be completely separated from each other, which might cause the product to fall away from the package. One way to do this is to increase the resistance provided by the seal 2807 as the product 2812 becomes more and more exposed. In some examples, a peel brake feature 2880 provides this function. The peel brake feature 2880 increases the resistance of the seal 2807, requiring the user to apply additional force to separate the first layer 2802 and the second layer 2804. In practice, the user will be able to pull apart the seal 2807 at a first speed by applying a particular amount of force. When the user encounters the peel brake feature as the first layer and the second layer are separated, the peel brake feature is activated. The resistance of the seal 2807 increases, and the speed of separation of the first layer 2802 and the second layer 2804 slows down. Thus, the peel brake feature 2880 acts as a speed bump, preventing the user from peeling open the package 2800 too quickly, which can sometimes lead to the product 2812 falling out of the package 2800 and onto the floor.

In the example of FIG. 28, the peel brake feature 2880 includes a widened seal zone portion 2883. The first seal edge 2838 has a first width 2857 at a seal zone portion 2881 that is adjacent to the widened seal zone portion 2883. The widened seal zone portion 2883 has a second width 2855 that is greater than the first width 2857. The second seal edge 2839 similarly has a narrower portion 2841 and a wider portion 2842.

In practice, when the user is opening the package, peeling the first layer 2802 apart from the second layer 2804 will cause the seal to be broken at the location of the narrower portions 2838 at the same time as the narrower portion 2841, and the seal will be broken at the location of the wider portion 2883 at the same time as at the wider portion 2842.

When the first layer 2802 and the second layer 2804 are peeled apart in the product seal zone portions 2881 and 2841, it requires a particular amount of force to pull the layers apart at a particular rate of speed. When the user encounters the widened seal zone portions 2883 and 2842, the peel brake feature is activated: in the widened seal zone portions 2883 and 2842, a greater force is required to peel apart the first layer and the second layer at the same rate of speed as in the narrower portions 2841 and 2881. As a result, if the user applies a uniform amount of force, the speed at which the layers are pulled apart will slow down at the location of the peel brake feature.

In some examples, the peel brake feature is activated when the user has peeled the sides of the package apart more than half of the distance from the apex of the product seal zone to the rear edge of the package. In some examples, the peel brake feature is located halfway down the seal edge, two thirds of the way down the seal edge, or three quarters of the way down the seal edge. For example, in a package that has a length of 3 inches from the apex of the product seal zone to the rear edge of the package, the peel brake feature can be located at a distance of greater than 1.5 inches from the apex, greater than 1.75 inches from the apex, greater than 2 inches from the apex, greater than 2.25 inches from the apex, or greater than 2.5 inches from the apex.

The location of the peel brake feature can vary based on the position of the product in relation to the unsealed pouch area. In some examples, the peel brake feature is located closer to the header zone than the rear edge of the product is. In some examples, the peel brake feature is located in such a position that a portion of the product is still enclosed by the product seal area when the peel brake feature is activated as the first layer is being peeled away from the second layer. The peel brake feature can be located such that not all of the product is exposed when the peel brake feature is activated as the package is being peeled open.

The width of the widened seal zone portions can vary depending upon the application. In some examples, the widened seal zone portion is 50 percent wider than the adjacent seal zone portion. In some examples, the widened seal zone portion is between 10 and 50 percent wider than the adjacent seal zone portion, between 25 and 75 percent wider than the adjacent seal zone portion, between 50 and 100 percent wider than the adjacent seal zone portion, between 75 and 125 percent wider than the adjacent seal zone portion, or between 100 and 150 percent wider than the adjacent seal zone portion. In some examples, the widened seal zone portion is greater than twice as wide as the adjacent seal zone portion. In some examples, the widened seal zone portion is between 50 and 100 percent wider than the adjacent seal zone portion.

Figure 29:
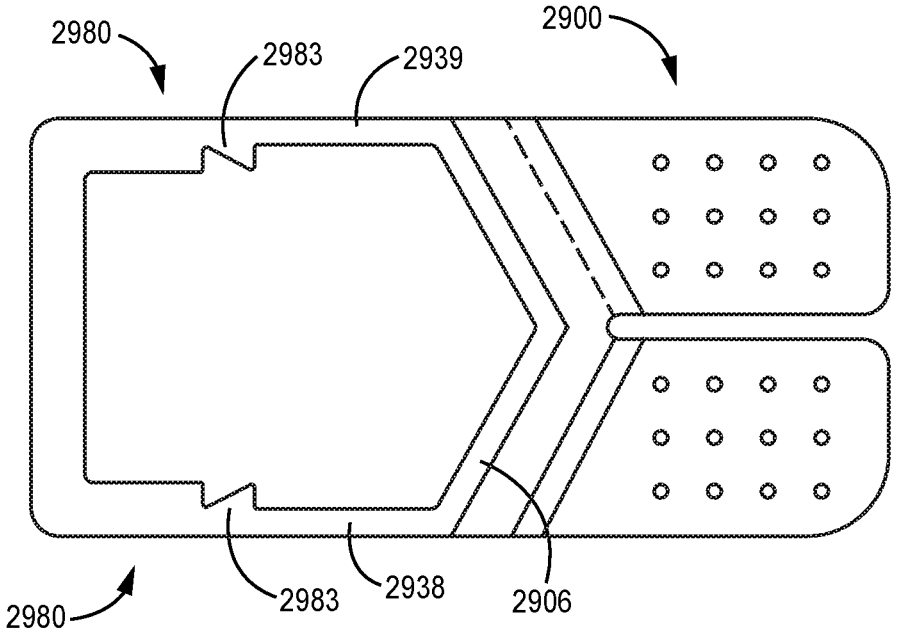
FIG. 29 is a front view of a package incorporating an alternative example of a peel brake feature.

FIG. 29 is a front view of a package 2900 incorporating an alternative example of a peel brake feature. In this example, the product seal zone 2906 includes a first seal edge 2938 and a second seal edge 2939. A peel brake feature 2980 includes a portion 2983 that has a changing width. In this example, the widths of the first seal edge 2938 and second seal edge 2939 first increase sharply, then decrease gradually, then increase sharply again as the user pulls apart the two layers of the package 2900. This variation in width gives the user tactile feedback to prevent the user from peeling apart the first and second layers too quickly or with too much force.

Figure 30:
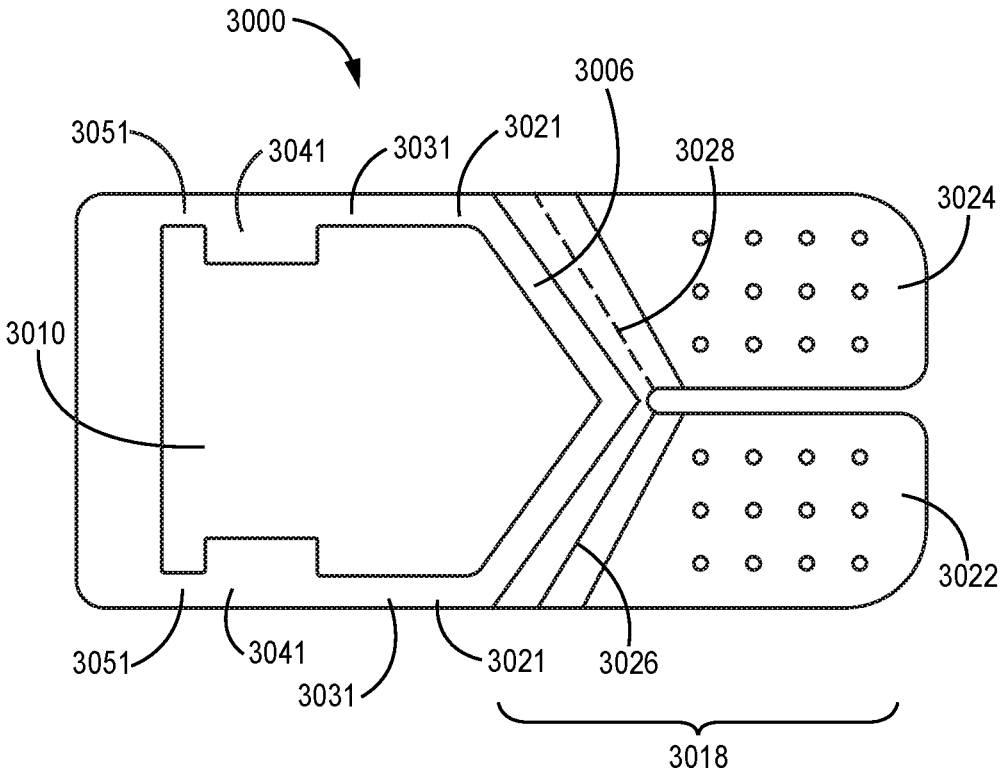
FIG. 30 is a front view of a package incorporating another alternative example of a peel brake feature.

FIG. 30 is a front view of a package 3000 incorporating another alternative example of a peel brake feature. Like the previous examples, the package 3000 has a first tab 3022 with a first tab-cut 3026, a second tab 3024 with a second tab-cut 3028, a product seal zone 3006, an unsealed product area 3010, and a header zone 3018.

In this example, the side edges 3021 of the product seal zone 3006 have a first edge portion 3031 having a first width, a second edge portion 3041 having a second width, and a third edge portion 3051 having a third width. The first edge portion 3031 is nearest the header zone 3018, and therefore will be peeled apart first when the user opens the package. Next the second edge portion 3041, which is farther from the header zone 3018 than the first edge portion, is encountered. The second edge portion 3041 has a greater width than the first edge portion 3031, and therefore the second edge portion 3041 has a greater resistance to being pulled apart. This slows down the speed at which the package 3000 will be opened. This variation in width between the portions 3031, 3041, and 3051 gives the user tactile feedback to prevent the user from peeling apart the first and second layers too quickly or with too much force. The width 3051 can be smaller than the width 3041. In some examples, the width 3051 can be approximately equal to the width of the first edge portion 3031.

Figure 31:
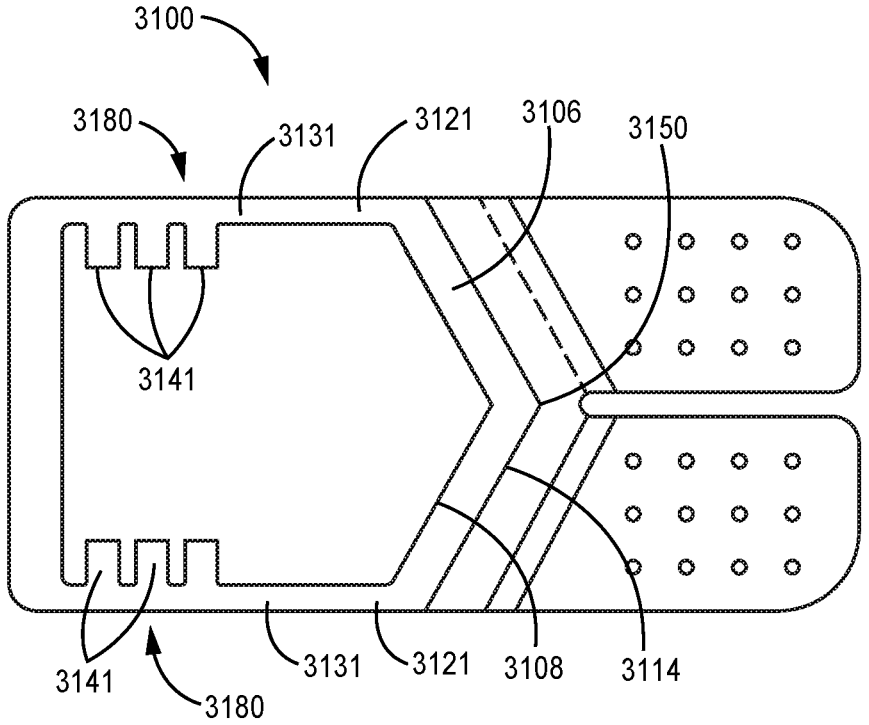
FIG. 31 is a front view of a package incorporating another alternative example of a peel brake feature.

FIG. 31 is a front view of a package 3100 incorporating another example of a peel brake feature. A product seal zone 3106 includes side edges 3121 having a first width at portion 3131. A series of width variations 3141 form a peel brake feature 3180. In this example, the force required to peel apart the first and second layers of the package 3100 first increases then decreases in quick succession, providing tactile feedback to the user, and slowing down the speed at which the layers can be pulled apart. In some examples, the width variations 3141 can have equal widths. In some examples, the widths of the width variations 3141 can, for example, increase or decrease toward the rear edge of the package. In some examples, the increased widths of the width variations can be interspersed with areas having a width approximately equal to the width of the first width portion 3131. In some cases the distance between the width variations 3041 is the same as the width of the width variations. The width variations can have a number of shapes. For example, the width variations can be rectangular with right angles, curved ends, rounded ends, or be irregularly shaped. The peel brake could have two, three, four, five, or another number of width variations 3141. The width variations 3141 could be equally spaced, could be wider closer to the closed end, could be narrower closer to the closed end, or have other spaced relationships.

Figure 32:
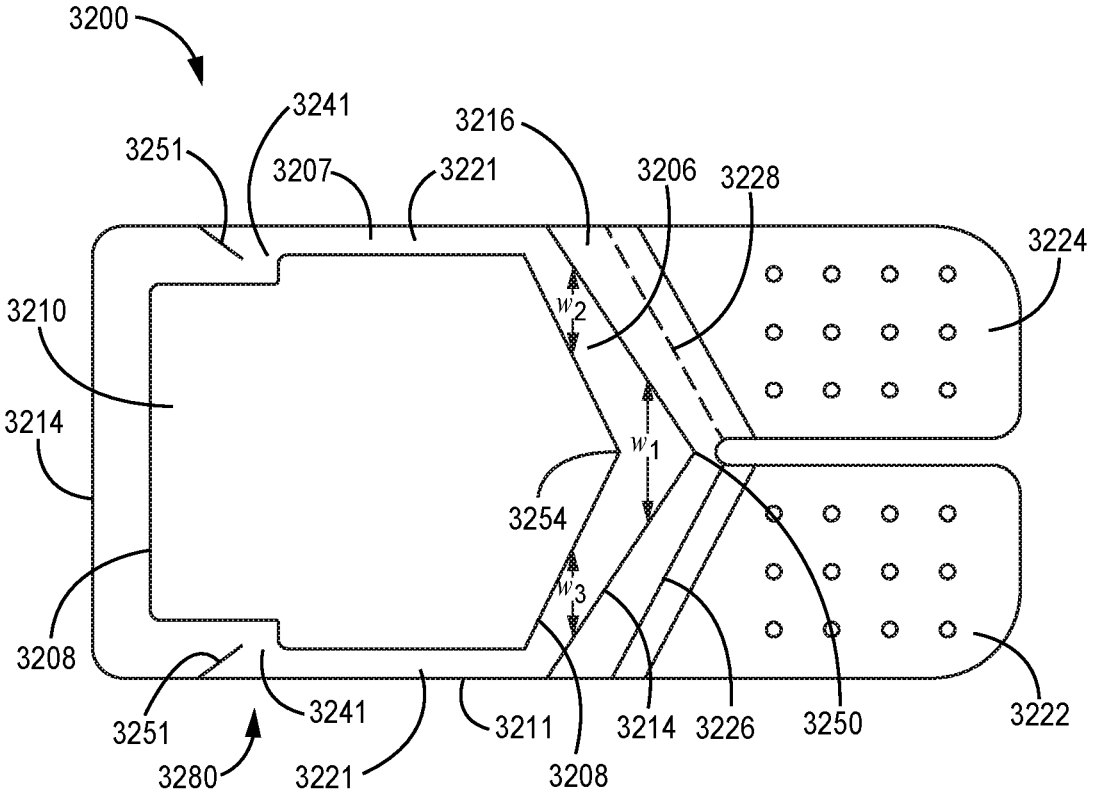
FIG. 32 is a front view of a package, according to some embodiments.

FIG. 32 is a front view of a package 3200, according to some embodiments. The package 3200 has a product seal zone 3206 that defines an unsealed pouch area 3210. The package 3200 has a first tab-cut 3226 and a second tab-cut 3228. In the example of FIG. 32, the product seal zone 3206 has an outer perimeter 3214 with a pentagon-shape and an inner perimeter 3208 that defines a pouch area 3210. In the example of FIG. 32, the apex 3250 of the outer perimeter 3214 forms a first chevron. The apex 3254 of the inner perimeter 3208 of the product seal zone 3206 also forms a second chevron. In FIG. 32, the apex 3250 forms a sharper peak than the apex 3254.

In comparison, in the example of FIG. 31, the inner perimeter 3108 is parallel to the outer perimeter 3114 at the apex 3150. As a result, the chevron at the apex 3250 of FIG. 32 is sharper than at the apex 3150 of FIG. 31.

The product seal zone has a cross-product seal width that is defined as the total width of the product seal zone that overlaps a line extending perpendicular from a first side edge to a second side edge. The cross-product seal width is broken in order to peel apart the layers of the package at a particular location or section along the side edges of the package. For example, referring to FIG. 32, the product seal zone 3206 has a first cross-product seal width that is equal to w1 at a first location in the product seal area near the apex 3250. The product seal zone 3206 has a second cross-product seal width that is equal to the width w2 plus the width w3 at a second location in the top product seal area near the seal edges that lie along the first and second side edges. In the example of FIG. 28, the package 2800 has a cross-product seal width of two times the first width 2857 (assuming that the width of seal zone portion 2881 is equal to the width of seal zone portion 2841) at a location along the side seal edges 2838, 2839. Also in the example of FIG. 28, the package 2800 has a second cross-seal width equal to two times the second width 2855 (assuming that the seal zone portion 2883 has the same width as seal zone portion 2842) at the location of the peel brake feature. The force necessary to peel apart the first layer and the second layer varies as a function of the cross-seal width. A greater cross-seal width requires greater force to break the seal at that point.

In some examples, a sharper chevron peak decreases the resistance of the seal 3207 when the package 3200 is being opened. This makes it easier to break the seal 3207 at the apex 3250, and the package is easier to open. In some examples, the chevron of the apex defined by the outer perimeter has an angle of between 90 degrees and 130 degrees. In some examples, the chevron of the apex has an angle of between 90 and 110 degrees, 100 and 120 degrees, 115 and 125 degrees, or between 120 and 130 degrees.

Both the sharpness of the angle of the chevron and the width of the product seal zone 3206 affect how easy or difficult it is to peel apart the layers of the package 3200. Whereas a sharp peak decreases the resistance of the seal 3207 to being broken when the tabs 3222 and 3224 are being pulled apart, the increased width at the apex 3250 increases the resistance of the seal 3207 to being broken. The width of the product seal zone 3206 at the apex 3250 and the sharpness of the chevron can be optimized as desired for particular applications of the technology.

The package 3200 also includes a peel brake feature 3280. In this example, the peel brake feature 3280 includes both a variable width feature 3241 and a peel interrupt feature 3251. The peel interrupt feature impedes the separation of the first layer from the second layer. The purpose of the peel interrupt feature is to further increase the resistance of the seal to being broken at the location of the peel brake feature. In some examples, the peel interrupt feature slows the speed at which the layers can be peeled apart. In alternative examples, the peel interrupt feature halts the process entirely, preventing the first layer and the second layer from being peeled apart any farther than the location of the peel interrupt feature. In some examples, the peel interrupt feature extends from the product seal zone to an exterior edge of the package. In some examples, the peel interrupt feature does not intersect the unsealed pouch area. In some examples, the peel interrupt feature is contained entirely within the area defined between the inner perimeter of the product seal zone and the outer perimeter of the product seal zone without intersecting either the exterior edge of the package or the unsealed pouch area.

In the example of FIG. 32, the peel interrupt feature 3251 is a weld in the seal side edge 3221 such as an ultrasonic weld or heat weld. In alternative examples, the peel interrupt feature 3251 could be a crimp, a cut in the first layer, a cut in the second layer, a cut in both the first and second layers, a notch, or an edge-cut in one or both of the layers that starts at the outer perimeter. In one example, a crimp is a location where the package is compressed during the manufacturing process. Where the peel interrupt feature is a cut or a crimp, it serves to direct the force of peeling apart the layers in the direction of the cut or crimp, interrupting the force being directed to separating the layers. Where the peel interrupt feature is a weld, the layers are permanently bonded together. A weld prevents the first layer from peeling away from the second layer at the location of the weld.

FIGS. 33-39 provide alternative examples of peel break features that can be used. In each of these figures, the peel brake feature includes a widened seal zone portion and a peel interrupt feature. However, it should be understood that a peel brake feature can incorporate a widened seal zone portion alone, a peel interrupt feature alone, multiple widened seal zone portions, multiple peel interrupt features, or any combination of these.

Figure 33:
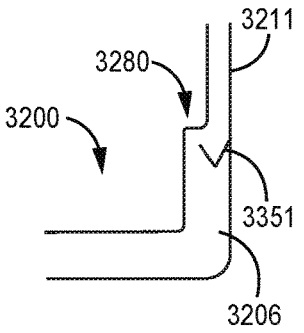
FIG. 33 is a partial front view of a package incorporating a peel interrupt feature, according to some embodiments.

FIG. 33 shows the package 3200 having a peel brake feature 3280 that includes a V-shaped weld, crimp, or cut 3351. The example of FIG. 33 shows the V-shaped peel interrupt feature 3351 extending all the way to the edge 3211 of the package 3200. In alternative examples, the V-shape could be contained entirely within the product seal zone 3206 without extending to the edge 3211.

Figure 34:
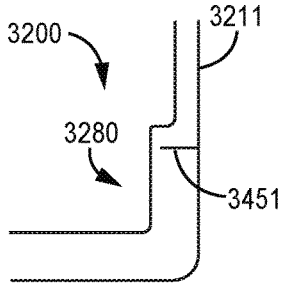
FIG. 34 is a partial front view of a package incorporating an alternative peel interrupt feature.
Figure 35:
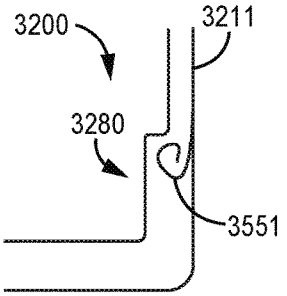
FIG. 35 is a partial front view of a package incorporating an alternative peel interrupt feature.
Figure 39:
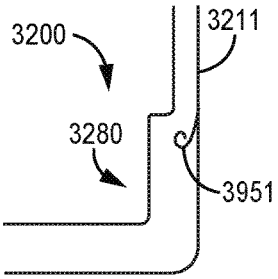
FIG. 39 is a partial front view of a package incorporating an alternative peel interrupt feature.

FIG. 34 shows the peel brake feature 3280 with a peel interrupt feature 3451 that is a straight line jutting from a side edge 3211 of the package 3200 in a perpendicular direction to the edge 3211 of the package 3200. FIG. 35 has a peel interrupt feature 3551 that is a curly-cue that begins at the side edge 3211 of the package 3200. FIG. 39 shows an alternative example of a curly-cue peel interrupt feature 3951 with a larger radius. During use, if the curly-cue is a cut, the first layer and the second layer of the product seal zone can be pulled apart up until the location of the curly-cue. When the curly-cue is encountered, the seal can be broken at the side edge of the package 3211, but at the center of the curly-cue, the first layer and the second layer will remain sealed together. Additional force must be applied to pull apart the first layer and the second layer at the center of the curly-cue, providing tactile feedback to the user to stop or slow down.

Figure 36:
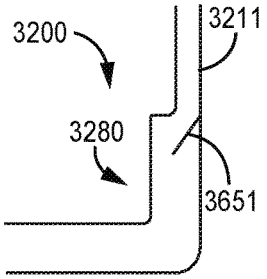
FIG. 36 is a partial front view of a package incorporating an alternative peel interrupt feature.
Figure 37:
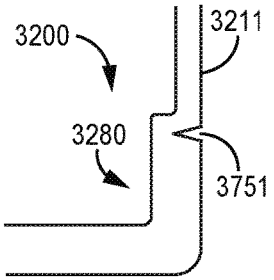
FIG. 37 is a partial front view of a package incorporating an alternative peel interrupt feature.
Figure 38:
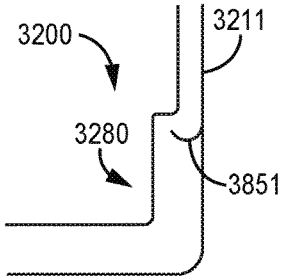
FIG. 38 is a partial front view of a package incorporating an alternative peel interrupt feature.

FIG. 36 shows a peel interrupt feature 3651 that begins at the side edge 3211 of the package 3200 and extends diagonally toward the end of the package 3200. FIG. 37 shows a peel interrupt feature that includes a notch 3751 in the side edge 3211 of the package 3200. FIG. 38 shows a curved semicircle peel interrupt feature that is concave in the direction of the header zone. Alternatively, the peel interrupt feature 3851 could be concave in the direction opposite the header zone. In another example, the peel interrupt feature could be a circular-shaped weld positioned in the seal side edge of the product seal zone.

The use of the different methods of making the peel interrupt features depends upon manufacturing needs. For example, an ultrasonic weld can provide a permanent seal to prevent the first layer from peeling apart from the second layer at the weld. However, this requires an extra manufacturing step, and additional manufacturing equipment. In contrast, a cut or notch can be accomplished without additional special equipment during manufacturing.

The embodiments of the present technology described herein are not intended to be exhaustive or to limit the technology to the precise forms disclosed in the following detailed description. Rather, the embodiments are chosen and described so that others skilled in the art can appreciate and understand the principles and practices of the present technology. The technology has been described with reference to various specific and preferred embodiments and techniques. However, it should be understood that many variations and modifications may be made while remaining within the spirit and scope of the technology.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

It should also be noted that, as used in this specification and the appended claims, the phrase "configured" describes a system, apparatus, or other structure that is constructed or configured to perform a particular task or adopt a particular configuration to. The phrase "configured" can be used interchangeably with other similar phrases such as arranged and configured, constructed and arranged, constructed, manufactured and arranged, and the like.

All publications and patent applications in this specification are indicative of the level of ordinary skill in the art to which this technology pertains. All publications and patent applications are herein incorporated by reference to the same extent as if each individual publication or patent application was specifically and individually indicated by reference. The publications and patents disclosed herein are provided solely for their disclosure. Nothing herein is to be construed as an admission that the inventors are not entitled to antedate any publication and/or patent, including those cited herein.

What is claimed is:

1. A method of dispensing a pharmaceutical product to a subject in need thereof, the method comprising opening a package to provide the subject with access to the pharmaceutical product, the package comprising:

a first layer;

a second layer;

a product seal zone where the first layer is joined to the second layer by a seal, the product seal zone having an inner perimeter and an outer perimeter, wherein the inner perimeter defines a single unsealed pouch area for containing the product; and a header zone adjacent to the outer perimeter of the product seal zone, wherein the header zone comprises:

a first tab;

a second tab;

a first tab-cut in the first layer within an unsealed portion of the header zone; and a second tab-cut in the second layer within the unsealed portion of the header zone;

wherein the first tab-cut does not intersect the second tab-cut;

wherein the package defines a void between the first tab and the second tab;

wherein the first tab-cut terminates at an edge of the package that defines a portion of the void; and wherein the second tab-cut terminates at the edge of the package that defines the portion of the void;

wherein the pharmaceutical product is disposed in the single unsealed pouch area prior to opening.

2. The method of claim 1, wherein the first layer web is joined to the second layer web in a first tab seal zone, and wherein the first layer web is joined to the second layer web in a second tab seal zone.

3. The method of claim 2, wherein an unsealed portion between the product seal zone and the first tab seal zone and the second tab seal zone extends across the package from one edge of a package perimeter to an opposite edge of the package perimeter.

4. The method of claim 1, wherein the first tab-cut extends from the void across a portion of the package to the perimeter of the package, and the second tab-cut extends from the void across a portion of the package to the perimeter of the package.

5. The method of claim 1, wherein the first tab-cut extends to a first side edge of the package and the second tab-cut extends to a second side edge of the package opposite from the first side edge.

6. The method of claim 1, wherein the first tab zone comprises a first tactile feature and the second tab zone comprises a second tactile feature, wherein each of the tactile features is selected from a group consisting of: an aperture, one or more slits, grooves, bumps, and recesses.

7. The method of claim 1, wherein the first tab zone comprises a first tactile feature and the second tab zone comprises a second tactile feature, wherein each of the tactile features defines an aperture and a dulling element along a portion of an aperture edge, and wherein the dulling element includes a folded portion of at least one of the first or second layer.

8. The method of claim 1, wherein there is no cut in the second layer at a location corresponding to the first tab-cut on the first layer and there is no cut in the first layer at a location corresponding to the second tab-cut on the second layer.

9. The method of claim 1, wherein the first tab-cut is not parallel with the second tab-cut.

10. The method of claim 1, further comprising a first score in the first layer and a second score in the second layer, wherein the first score is parallel to the second score, and wherein the first score and the second score each extend from one end of the package to an opposite end of the package.

11. The method of claim 1, wherein the product seal zone comprises a peel brake feature, wherein the product seal zone requires a user to apply more force to separate the first layer from the second layer at the peel brake feature than along a portion of the product seal zone adjacent to the peel brake feature.

12. The method of claim 1, wherein the peel brake feature comprises a peel interrupt feature that impedes the separation of the first layer from the second layer, wherein the peel interrupt feature comprises at least one from the group comprising:

a crimp,
a cut in at least one of the first layer and the second layer,
an edge-cut in at least one of the first layer and the second layer that starts at the outer perimeter,
a notch,
a weld, and
an ultrasonic weld.

13. The method of claim 1, wherein the product seal zone has a variable width that varies along a side edge of the package, the variable width comprising a first width at a first portion of the product seal zone and a second width greater than the first width at a second portion of the product seal zone, wherein the first portion of the product seal zone is closer to the header zone than the second portion, whereby the variable width along the side edge requires a user to apply increased force to separate the first layer from the second layer at an end of the package opposite the header zone.

14. The method of claim 1, wherein a portion of the product seal zone that is adjacent to a top seal zone requires less force to separate the first layer from the second layer than a portion of the product seal zone that is on the opposite end of the package from the header zone.

15. The method of claim 1, wherein the pharmaceutical product is a soluble film.

16. A method of addressing an urgent medical need in a subject, the method comprising administering a pharmaceutical product from a package comprising:

a first layer;
a second layer;
a product seal zone where the first layer is joined to the second layer by a seal, the product seal zone having an inner perimeter and an outer perimeter, wherein the inner perimeter defines a single unsealed pouch area for containing the product; and
a header zone adjacent to the outer perimeter of the product seal zone, wherein the header zone comprises:
a first tab;
a second tab;
a first tab-cut in the first layer within an unsealed portion of the header zone; and
a second tab-cut in the second layer within the unsealed portion of the header zone;
wherein the first tab-cut does not intersect the second tab-cut;
wherein the package defines a void between the first tab and the second tab;
wherein the first tab-cut terminates at an edge of the package that defines a portion of the void; and
wherein the second tab-cut terminates at the edge of the package that defines the portion of the void; wherein the pharmaceutical product is disposed in the single unsealed pouch area.

17. A method of addressing an urgent medical need in a subject, the method comprising the user gaining access to a pharmaceutical product by opening a package comprising:

a first layer;
a second layer;
a product seal zone where the first layer is joined to the second layer by a seal, the product seal zone having an inner perimeter and an outer perimeter, wherein the inner perimeter defines a single unsealed pouch area for containing the product; and
a header zone adjacent to the outer perimeter of the product seal zone, wherein the header zone comprises:
a first tab;
a second tab;
a first tab-cut in the first layer within an unsealed portion of the header zone; and
a second tab-cut in the second layer within the unsealed portion of the header zone;
wherein the first tab-cut does not intersect the second tab-cut;
wherein the package defines a void between the first tab and the second tab;
wherein the first tab-cut terminates at an edge of the package that defines a portion of the void; and
wherein the second tab-cut terminates at the edge of the package that defines the portion of the void; wherein the pharmaceutical product is disposed in the single unsealed pouch area prior to opening.

* * * * *